US007286677B2

(12) United States Patent
Killion et al.

(10) Patent No.: US 7,286,677 B2
(45) **Date of Patent: *Oct. 23, 2007**

(54) DIRECTIONAL MICROPHONE ASSEMBLY

(75) Inventors: Mead C. Killion, Elk Grove Village, IL (US); Robert B. Schulein, Schaumburg, IL (US); Timothy S. Monroe, Schaumburg, IL (US); Viorel Drambarean, Skokie, IL (US); Andrew J. Haapapuro, Schaumburg, IL (US); John S. French, Arlington Heights, IL (US)

(73) Assignee: Etymotic Research, Inc., Elk Grove Village, IL (US)

(*) Notice: Subject to any disclaimer, the term of this patent is extended or adjusted under 35 U.S.C. 154(b) by 494 days.

This patent is subject to a terminal disclaimer.

(21) Appl. No.: 10/889,420

(22) Filed: Jul. 12, 2004

(65) Prior Publication Data

US 2004/0247146 A1 Dec. 9, 2004

(51) Int. Cl.
*H04R 25/00* (2006.01)

(52) U.S. Cl. ..... 381/313; 381/387; 381/369

(58) Field of Classification Search ..... 381/313, 381/355, 356–358, 369, 387
See application file for complete search history.

(56) References Cited

U.S. PATENT DOCUMENTS

| | | | |
|---|---|---|---|
| 2,950,357 | A | 8/1960 | Mitchell et al. |
| 3,662,124 | A | 5/1972 | Hassler et al. |
| 3,770,911 | A | 11/1973 | Knowles et al. |
| 3,798,390 | A | 3/1974 | Gage et al. |
| 3,835,263 | A | 9/1974 | Killion |
| 3,836,732 | A | 9/1974 | Johanson et al. |
| 3,875,349 | A | 4/1975 | Ruegg |
| 3,930,560 | A | 1/1976 | Carlson et al. |
| 3,935,398 | A | 1/1976 | Carlson et al. |
| 3,947,646 | A | 3/1976 | Saito |
| 3,975,599 | A | 8/1976 | Johanson |
| 3,983,336 | A | 9/1976 | Malek et al. |
| 4,073,366 | A | 2/1978 | Estes |
| 4,281,222 | A | 7/1981 | Nakagawa et al. |

(Continued)

FOREIGN PATENT DOCUMENTS

CH 681411 A5 12/1978

(Continued)

OTHER PUBLICATIONS

Killion, Design and Evaluation Of High-Fidelity Hearing Aid 1979.

(Continued)

*Primary Examiner*—Suhan Ni
(74) *Attorney, Agent, or Firm*—McAndrews, Held & Malloy, Ltd.

(57) ABSTRACT

A directional microphone assembly for a hearing aid is disclosed. The hearing aid has one or more microphone cartridge(s), and first and second sound passages. Inlets to the sound passages, or the sound passages themselves, are spaced apart such that the shortest distance between them is less than or approximately equal to the length of the microphone cartridge(s). A sound duct and at least one surface of a microphone cartridge may form each sound passage, where the sound duct is mounted with the microphone cartridge. Alternatively, each sound duct may be formed as an integral part of a microphone cartridge.

7 Claims, 39 Drawing Sheets

U.S. PATENT DOCUMENTS

| | | | |
|---|---|---|---|
| 4,393,270 | A | 7/1983 | Van den Berg |
| 4,399,327 | A | 8/1983 | Yamamoto et al. |
| 4,434,329 | A | 2/1984 | Nasu |
| 4,456,795 | A | 6/1984 | Saito |
| 4,456,796 | A | 6/1984 | Nakagawa et al. |
| 4,629,833 | A | 12/1986 | Kern et al. |
| 4,703,506 | A | 10/1987 | Sakamoto et al. |
| 4,850,016 | A | 7/1989 | Groves et al. |
| 5,058,171 | A | 10/1991 | Wurzer et al. |
| 5,121,426 | A | 6/1992 | Baumhauer et al. |
| 5,131,046 | A | 7/1992 | Killion et al. |
| 5,204,907 | A | 4/1993 | Staple et al. |
| 5,214,709 | A | 5/1993 | Ribic |
| 5,226,076 | A | 7/1993 | Baumhauer, Jr. et al. |
| 5,268,965 | A | 12/1993 | Badie et al. |
| 5,511,130 | A | 4/1996 | Bartlett et al. |
| 5,524,056 | A | 6/1996 | Killion et al. |
| 5,613,011 | A | 3/1997 | Chase et al. |
| 5,613,013 | A | 3/1997 | Schuette |
| 5,703,957 | A | 12/1997 | McAteer |
| 5,757,933 | A | 5/1998 | Preves et al. |
| 5,790,679 | A | 8/1998 | Hawker et al. |
| 5,848,172 | A | 12/1998 | Allen et al. |
| 5,878,147 | A | 3/1999 | Killion et al. |
| 6,031,922 | A | 2/2000 | Tibbetts |
| 6,075,869 | A | 6/2000 | Killion et al. |
| 6,134,334 | A | 10/2000 | Killion et al. |
| 6,151,399 | A | 11/2000 | Killion et al. |
| 6,285,771 | B1 | 9/2001 | Killion et al. |
| 6,567,526 | B1 | 5/2003 | Killion et al. |

FOREIGN PATENT DOCUMENTS

| | | | |
|---|---|---|---|
| DE | 3207412 | A1 | 9/1983 |
| DE | 4026420 | A1 | 8/1990 |
| EP | 046676 | A3 | 6/1991 |
| EP | 0466676 | A2 | 6/1991 |
| FR | 2500248 | | 8/1982 |
| FR | 2562789 | A1 | 4/1985 |

OTHER PUBLICATIONS

Killion, "Why Some Hearing Aids Don't Work Well!!", The Hearing Review, Jan. 1994, pp. 40-42.

Zuercher et al, << Small Acoustic Tubes: New Approximations Including Isothermal and Viscous Effects, J. Acoust. Soc. Am., V. 83, pp. 1653-1660, Apr. 1988.

Mueller et al, << An Easy Method for Calculating the Articulation Index >>, The Hearing Journal, vol. 43, No. 9, Sep. 1990, pp. 1-4.

Burnett et al, "Nist Hearing Aid Test Procedures and Test Date", VA Hearing Aid Handbook, 1989, pp. 9, 23.

Carhart and Tillman, "Interaction of Competing Speech Signals with Hearing Losses", Archives of Otolaryngology, vol. 91, pp. 273-279, 1970.

Hawkins and Yacullo, "Signals-to-Noise Ratio Advantage of Binaural Hearing Aids and Directional Microphones Under Different Levels of Reverberation", J. Speech and Hearing Disorders, vol. 49, pp. 278-286, 1984.

Killion, "The Noise Problem: There's Hope", Hearing Indtruments, vol. 36, No. 11, pp. 26-32, 1985.

Ora Buerkli-Halevy,"MA-The Directional Microphone Advantage", Aug. 1987/Cleveland, OH.

Peter L. Madaffari, "Directional Matrix Technical Report", Industrial Research Products, Inc. Project 10554, Report No. 10554-1, May 7, 1983.

Carlson and Killion, "Subminiature Microphones", J. Audio Engineering Society, vol. 22, pp. 92-96, 1974.

Wim Soede, "Improvement in Speech Intelligibility in Noise-Development and Evaluation of a New Directional Hearing Instrument Based on Array Technology", 1990.

"Etymotic Research-D-MIC 2nd Order Directional Progress: As of Apr. 27, 1994".

Wim Soede et al, "Assessment of a Directional Microphone Array for Hearing-Impaired Listeners", J. Acoust. Soc. Am., Aug. 1993, vol. 94 No. 2, pp. 799-808.

Knowles Electronics, Inc., "EB Directional Hearing Aid Microphone Application Notes", TB-21, S-324-1280.

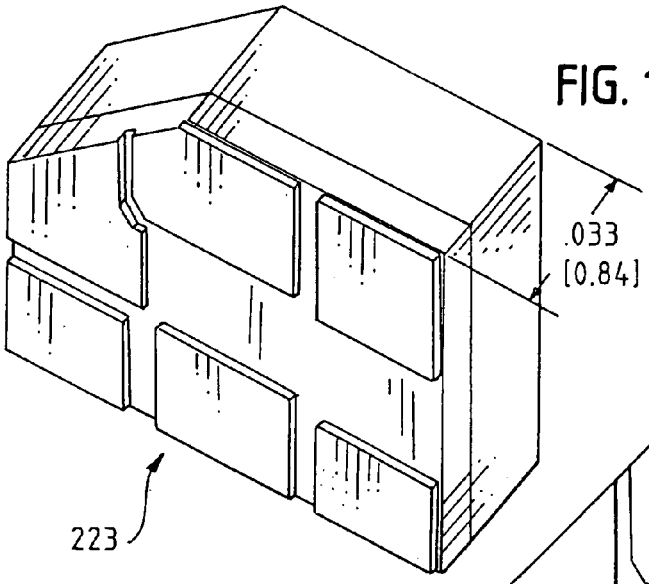
FIG. 18A
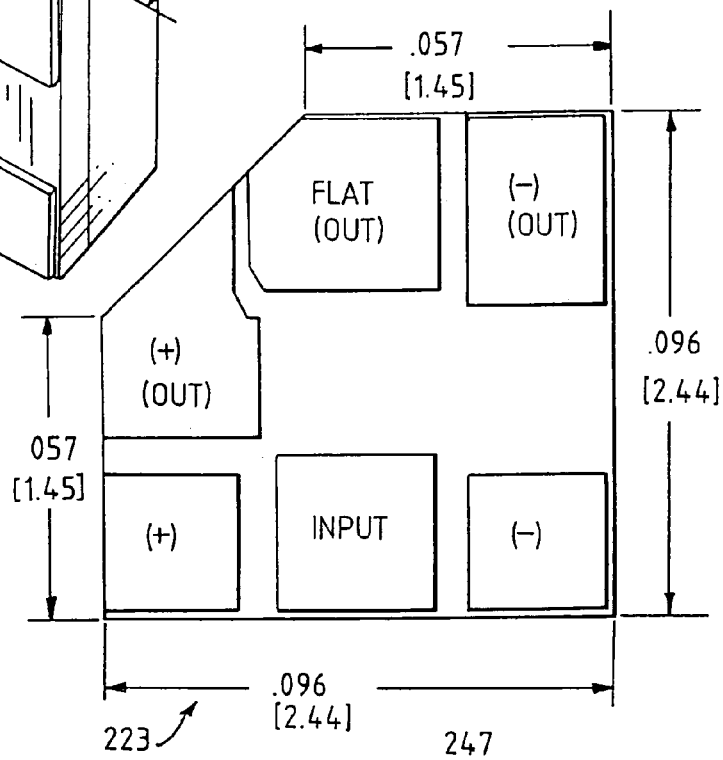
FIG. 18B
FIG. 19
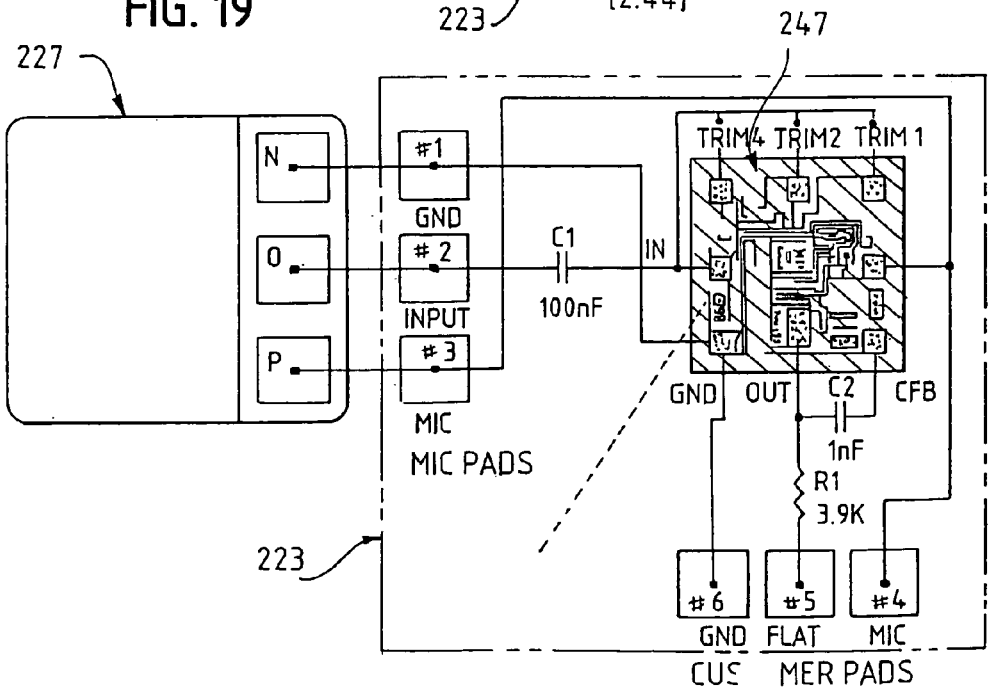

DIRECTIONAL MICROPHONE ASSEMBLY

CROSS-REFERENCE TO RELATED APPLICATIONS

This application makes reference to and claims priority to and the benefit of U.S. Non-Provisional patent application Ser. No. 09/973,078 filed on Oct. 5, 2001, which in turn claims priority to U.S. Provisional Patent Application Ser. No. 60/237,988 filed Oct. 5, 2000 and hereby incorporates herein by reference the respective entireties thereof.

This application also makes reference to and claims priority to and the benefit of U.S. Non-Provisional patent application Ser. No. 09/565,262 filed on May 5, 2000, which is a continuation-in-part of U.S. Non-Provisional patent application Ser. No. 09/252,572 filed Feb. 18, 1999, which is a continuation-in-part of U.S. Non-Provisional patent application Ser. No. 08/775,139 filed Dec. 31, 1996 now U.S. Pat. No. 5,878,147 issued Mar. 2, 1999 and hereby incorporates herein by reference the respective entireties thereof.

This application also hereby incorporates herein by reference U.S. Provisional Patent Application Ser. No. 60/237,988, U.S. Pat. No. 5,878,147, and U.S. Pat. No. 5,524,056 in their respective entireties.

BACKGROUND OF THE INVENTION

The application of directional microphones to hearing aids is well known in the patent literature (Wittkowski, U.S. Pat. No. 3,662,124 dated 1972; Knowles and Carlson, U.S. Pat. No. 3,770,911 dated 1973; Killion, U.S. Pat. No. 3,835,263 dated 1974; Ribic, U.S. Pat. No. 5,214,709, and Killion et al. U.S. Pat. No. 5,524,056, 1996) as well as commercial practice (Maico hearing aid model MC033, Qualitone hearing aid model TKSAD, Phonak "Audio-Zoom" hearing aid, and others).

Directional microphones are used in hearing aids to make it possible for those with impaired hearing to carry on a normal conversation at social gatherings and in other noisy environments. As hearing loss progresses, individuals require greater and greater signal-to-noise ratios in order to understand speech. Extensive digital signal processing research has resulted in the universal finding that nothing can be done with signal processing alone to improve the intelligibility of a signal in noise, certainly in the common case where the signal is one person talking and the noise is other people talking. There is at present no practical way to communicate to the digital processor that the listener now wishes to turn his attention from one talker to another, thereby reversing the roles of signal and noise sources.

It is important to recognize that substantial advances have been made in the last decade in the hearing aid art to help those with hearing loss hear better in noise. Available research indicates, however, that the advances amounted to eliminating defects in the hearing aid processing, defects such as distortion, limited bandwidth, peaks in the frequency response, and improper automatic gain control or AGC action. Research conducted in the 1970's, before these defects were corrected, indicated that the wearer of hearing aids typically experienced an additional deficit of 5 to 10 dB above the unaided condition in the signal-to-noise ratio ("S/N") required to understand speech. Normal hearing individuals wearing those same hearing aids might also experience a 5 to 10 dB deficit in the S/N required to carry on a conversation, indicating that it was indeed the hearing aids that were at fault. These problems were discussed by Applicant Killion in a recent paper "Why some hearing aids don't work well!!!" (Hearing Review, January 1994, pp. 40-42).

Recent data obtained by the Applicants confirm that hearing impaired individuals need an increased signal-to-noise ratio even when no defects in the hearing aid processing exist. As measured on one popular speech-in-noise test, the SIN test, those with mild loss typically need some 2 to 3 dB greater S/N than those with normal hearing; those with moderate loss typically need 5 to 7 dB greater S/N; those with severe loss typically need 9 to 12 dB greater S/N. These figures were obtained under conditions corresponding to defect free hearing aids.

As described below, a headworn first-order directional microphone can provide at least a 3 to 4 dB improvement in signal-to-noise ratio compared to the open ear, and substantially more in special cases. This degree of improvement will bring those with mild hearing loss back to normal hearing ability in noise, and substantially reduce the difficulty those with moderate loss experience in noise. In contrast, traditional omnidirectional head-worn microphones cause a signal-to-noise deficit of about 1 dB compared to the open ear, a deficit due to the effects of head diffraction and not any particular hearing aid defect.

A little noticed advantage of directional microphones is their ability to reduce whistling caused by feedback (Knowles and Carlson, 1973, U.S. Pat. No. 3,770,911). If the ear-mold itself is well fitted, so that the vent outlet is the principal source of feedback sound, then the relationship between the vent and the microphone may sometimes be adjusted to reduce the feedback pickup by 10 or 20 dB. Similarly, the higher-performance directional microphones have a relatively low pickup to the side at high frequencies, so the feedback sound caused by faceplate vibration will see a lower microphone sensitivity than sounds coming from the front.

Despite these many advantages, the application of directional microphones has been restricted to only a small fraction of Behind-The-Ear (BTE) hearing aids, and only rarely to the much more popular In-The-Ear (ITE) hearing aids which presently comprise some 80% of all hearing aid sales.

Part of the reason for this low usage was discovered by Madafarri, who measured the diffraction about the ear and head. He found that for the same spacing between the two inlet ports of a simple first-order directional microphone, the ITE location produced only half the microphone sensitivity. Madafarri found that the diffraction of sound around the head and ear caused the effective port spacing to be reduced to about 0.7 times the physical spacing in the ITE location, while it was increased to about 1.4 times the physical spacing in the BTE location. In addition to a 2:1 sensitivity penalty for the same port spacing, the constraints of ITE hearing aid construction typically require a much smaller port spacing, further reducing sensitivity.

Another part of the reason for the low usage of directional microphones in ITE applications is the difficulty of providing the front and rear sound inlets plus a microphone cartridge in the space available. As shown in FIG. 17 of the '056 patent mentioned above, the prior art uses at least one metal inlet tube (often referred to as a nipple) welded to the side of the microphone cartridge and a coupling tube between the microphone cartridge and the faceplate of the hearing aid. The arrangement of FIG. 17 of the '056 patent wherein the microphone cartridge is also parallel with the faceplate of the hearing aide forces a spacing D as shown in that figure which may not be suitable for all ears.

A further problem is that of obtaining good directivity across frequency. Extensive experiments conducted by Madafarri as well as by the Applicants over the last 25 years have shown that in order to obtain good directivity across the audio frequencies in a head-worn directional microphone it, requires great care and a good understanding of the operation of sound in tubes (as described, for example, by Zuercher, Carlson, and Killion in their paper "Small acoustic tubes," J. Acoust. Soc. Am., V. 83, pp. 1653-1660, 1988).

A still further problem with the application of directional microphones to hearing aids is that of microphone noise. Under normal conditions, the noise of a typical non-directional hearing aid microphone cartridge is relatively unimportant to the overall performance of a hearing aid. Sound field tests show that hearing aid wearers can often detect tones within the range of 0 to 5 dB Hearing Level, i.e., within 5 dB of average young normal listeners and well within the accepted 0 to 20 dB limits of normal hearing. But when the same microphone cartridges are used to form directional microphones, a low frequency noise problem arises. The subtraction process required in first-order directional microphones results in a frequency response falling at 6 dB/octave toward low frequencies. As a result, at a frequency of 200 Hz, the sensitivity of a directional microphone may be 30 dB below the sensitivity of the same microphone cartridge operated in an omnidirectional mode.

When an equalization amplifier is used to correct the directional microphone frequency response for its low frequency drop in sensitivity, the amplifier also amplifies the low frequency noise of the microphone. In a reasonably quiet room, the amplified low frequency microphone noise may now become objectionable. Moreover, with or without equalization, the masking of the microphone noise will degrade the best aided sound field threshold at 200 Hz to approximately 35 dB HL, approaching the 40 dB HL lower limits for what is considered a moderate hearing impairment.

The equalization amplifier itself also adds to the complication of the hearing aid circuit. Thus, even in the few cases where ITE aids with directional microphones have been available, to applicant's knowledge, their frequency response has never been equalized. For this reason, Killion et al (U.S. Pat. No. 5,524,056) recommend a combination of a conventional omnidirectional microphone and a directional microphone so that the lower internal noise omnidirectional microphone may be chosen during quiet periods while the external noise rejecting directional microphone may be chosen during noisy periods.

Although directional microphones appear to be the only practical way to solve the problem of hearing in noise for the hearing-impaired individual, they have been seldom used even after nearly three decades of availability. It is the purpose of the present invention to provide an improved and fully practical directional microphone for ITE hearing aids.

Before summarizing the invention, a review of some further background information will be useful. Since the 1930s, the standard measure of performance in directional microphones has been the "directivity index" or DI, the ratio of the on-axis sensitivity of the directional microphone (sound directly in front) to that in a diffuse field (sound coming with equal probability from all directions, sometimes called random incidence sound). The majority of the sound energy at the listener's eardrum in a typical room is reflected, with the direct sound often less than 10% of the energy. In this situation, the direct path interference from a noise source located at the rear of a listener may be rejected by as much as 30 dB by a good directional microphone, but the sound reflected from the wall in front of the listener will obviously arrive from the front where the directional microphone has (intentionally) good sensitivity. If all of the reflected noise energy were to arrive from the front, the directional microphone could not help.

Fortunately, the reflections for both the desired and undesired sounds tend to be more or less random, so the energy is spread out over many arrival angles. The difference between the "random incidence" or "diffuse field" sensitivity of the microphone and its on-axis sensitivity gives a good estimate of how much help the directional microphone can give in difficult situations. An additional refinement can be made where speech intelligibility is concerned by weighing the directivity index at each frequency to the weighing function of the Articulation Index as described, for example, by Killion and Mueller on page 2 of The Hearing Journal, Vol. 43, Number 9, September 1990. Table 1 gives one set of weighing values suitable for estimating the equivalent overall improvement in signal-to-noise ratio as perceived by someone trying to understand speech in noise.

The directivity index (DI) of the two classic, first-order directional microphones, the "cosine" and "cardioid" microphones, is 4.8 dB. In the first case the microphone employs no internal acoustic time delay between the signals at the two inlets, providing a symmetrical figure 8 pattern. The cardioid employs a time delay exactly equal to the time it takes on-axis sound to travel between the two inlets. Compared to the cosine microphone, the cardioid has twice the sensitivity for sound from the front and zero sensitivity for sound from the rear. A further increase in directivity performance can be obtained by reducing the internal time delay. The hypercardioid, with minimum sensitivity for sound at 110 degrees from the front, has a DI of 6 dB. The presence of head diffraction complicates the problem of directional microphone design. For example, the directivity index for an omni BTE or ITE microphone is −1.0 to −2.0 dB at 500 and 1000 Hz.

Recognizing the problem of providing good directional microphone performance in a headworn ITE hearing aid application, applicant's set about to discover improved means and methods of such application. It is readily understood that the same solutions that make an ITE application practical can be easily applied to BTE applications as well.

BRIEF SUMMARY OF THE INVENTION

Aspects of the present invention may be found in a hearing aid having one or more microphone cartridge(s). The hearing aid also has a first sound passage that couples sound energy to a first sound port of one of the microphone cartridge(s), and a second sound passage that couples sound energy to a second sound port of one of the microphone cartridge(s). The longest distance between first and second sound inlets of the first and second sound passages, respectively, is less than or approximately equal to the sum of the length of the microphone cartridge(s), the diameter of the first sound inlet and the diameter of the second sound inlet. The longest distance may be, for example, less than approximately 0.258 inches, such as 0.215 inches for example.

The diameters of the first and second sound inlets may be approximately equal, for example. The first and second sound inlets may have, for example, a center to center spacing of less than approximately 0.2 inches, such as approximately 0.157 inches, for example.

In another embodiment, the hearing aid has one or more microphone cartridge(s), and first and second sound ducts. The microphone cartridge(s) have first and second ports located, respectively, on first and second outer surfaces of the microphone cartridge(s). The first and second sound ducts likewise have, respectively, first and second inner surfaces. The first sound duct is operatively coupled to at least the first outer surface of a microphone cartridge, and the second sound duct is operatively coupled to at least the second outer surface of, for example, the same microphone cartridge (or a different microphone cartridge in the case of two or more microphone cartridges). The inner surface of the first sound duct and at least the first outer surface of the microphone cartridge create a volume representative of a first sound passage to the first port, and the inner surface of the second sound duct and at least the second outer surface of the microphone cartridge create a volume representative of a second sound passage to the second port.

In a further embodiment the hearing aid has one or more microphone cartridges, a first sound passage communicating with a microphone cartridge, and a second sound passage communicating with, for example, the same microphone cartridge (or a different microphone cartridge in the case of a two or more microphone cartridges). The shortest distance between the first and second sound passages is less than or approximately equal to the length of the one or more microphone cartridges. Such distance may be, for example, less than approximately 0.142 inches, such as 0.092 inches, for example.

In still a further embodiment, the hearing aid has a housing with an outer surface, such as formed by a faceplate for example, which in turn has first and second sound inlets. First and second sound passages couple sound energy from, respectively, the first and second sound inlets to, respectively, a microphone cartridge (or to separate microphone cartridges in the case of two or more microphone cartridges). The shortest distance between the first and second sound inlets may be, for example, less than or approximately equal to the length of the one or more microphone cartridges. Again, such distance may be, for example, less than approximately 0.142 inches, such as 0.092 inches, for example.

In the above embodiments, the first and second sound passages may be formed by, respectively, first and second sound ducts, where the first and second sound ducts are mounted with the microphone cartridge(s). Alternatively, the sound ducts may be formed as integral portions of the microphone cartridge(s). In addition, the sound passages may be formed in whole or in part in a housing portion, such as a faceplate for example, of the hearing aid.

The hearing aid may be, for example, an in-the-ear hearing aid or a behind-the-ear hearing aid, and the microphone cartridge(s) may be, for example, a directional cartridge in the case of a single cartridge design, or more than one omnidirectional cartridge (or some combination of directional and omnidirectional cartridges, in the case of a multiple cartridge design).

BRIEF DESCRIPTION OF THE DRAWINGS

FIGS. 11 and 12 are engaged to form a complete directional microphone cartridge having integrated sound ducts.

FIGS. 18A and 18B show exemplary details of the equalization hybrid of FIG. 17.

FIG. 19 is a diagram illustrating an exemplary interconnection between the directional microphone cartridge and the equalization hybrid of FIG. 17.

DETAILED DESCRIPTION OF THE INVENTION

Figure 1:
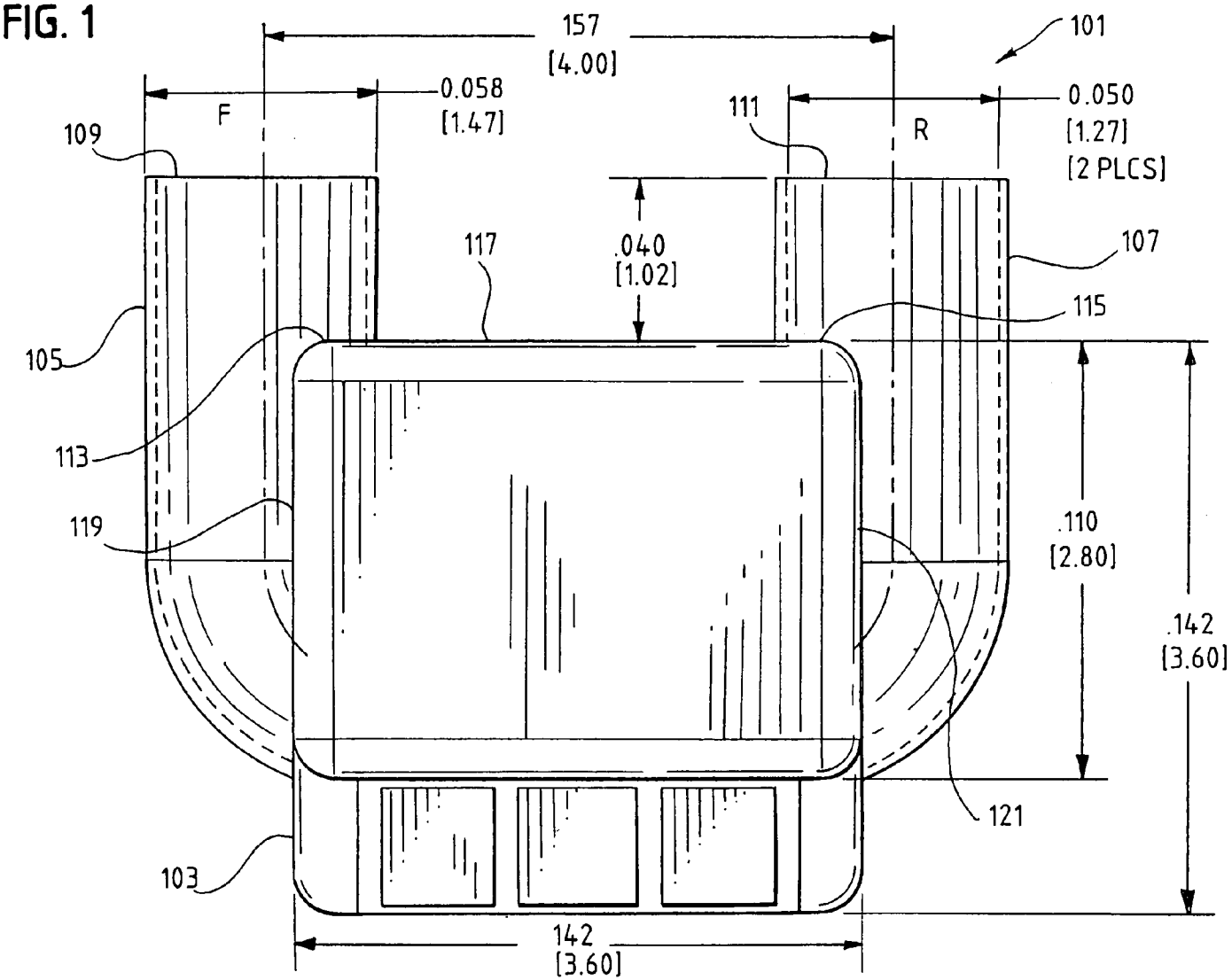
FIG. 1 illustrates a side view of one embodiment of a directional microphone assembly in accordance with the present invention.

FIG. 1 illustrates a side view of one embodiment of a directional microphone assembly in accordance with the present invention. Directional microphone assembly 101 comprises a directional microphone cartridge 103 and sound ducts or tubes 105 and 107. Directional microphone cartridge 103 may have a height dimension of only approximately 0.142 inches (3.60 mm) and a length dimension of only approximately 0.142 inches (3.60 mm), for example, a shown in FIG. 1. Directional microphone cartridge 103 may be made from a Knowles™ 4568 cartridge or a Microtronics 6368, for example. Of course, directional microphone cartridge 103 may have other dimensions, and may be made from other types of cartridges, than those specifically listed.

Sound ducts 105 and 107 form front and rear sound inlet passages, respectively, for coupling of sound energy from the sound field to the directional microphone cartridge 103. Sound duct 105 has a port or inlet 109 that may have an inner diameter of 0.050 inches (1.27 mm) and an outer diameter of 0.058 inches (1.47 mm), for example. Sound duct 107 has a similar port or inlet 111, which may have the same dimensions as port 109. The center of inlet 109 may be spaced apart a distance of 0.157 inches (4.00 mm), for example, from the center of inlet 111, as shown in FIG. 1.

Also, as can be seen from FIG. 1, sound ducts 105 and 107 may be mounted with directional microphone cartridge 103 such that portions 113 and 115 of the directional microphone cartridge 103 extend partially into sound ducts 105 and 107, respectively (as explained more completely below). In addition, each of sound ducts 105 and 107 may extend only 0.040 inches (1.02 mm), for example, above a top surface 117 of the directional microphone cartridge 103. Given the configuration shown in FIG. 1, therefore, the overall longest (i.e., length) dimension of the total directional microphone assembly 103 may be approximately 0.215 inches (5.47 mm) or less. This length is shorter than the total length obtained by combining the length of the directional microphone cartridge 103 with the diameter dimensions of both the inlet ports 109 and 111. The directional microphone assembly 103 may also have a height dimension of approximately 0.182 inches (4.62 mm) or less.

Figure 2:
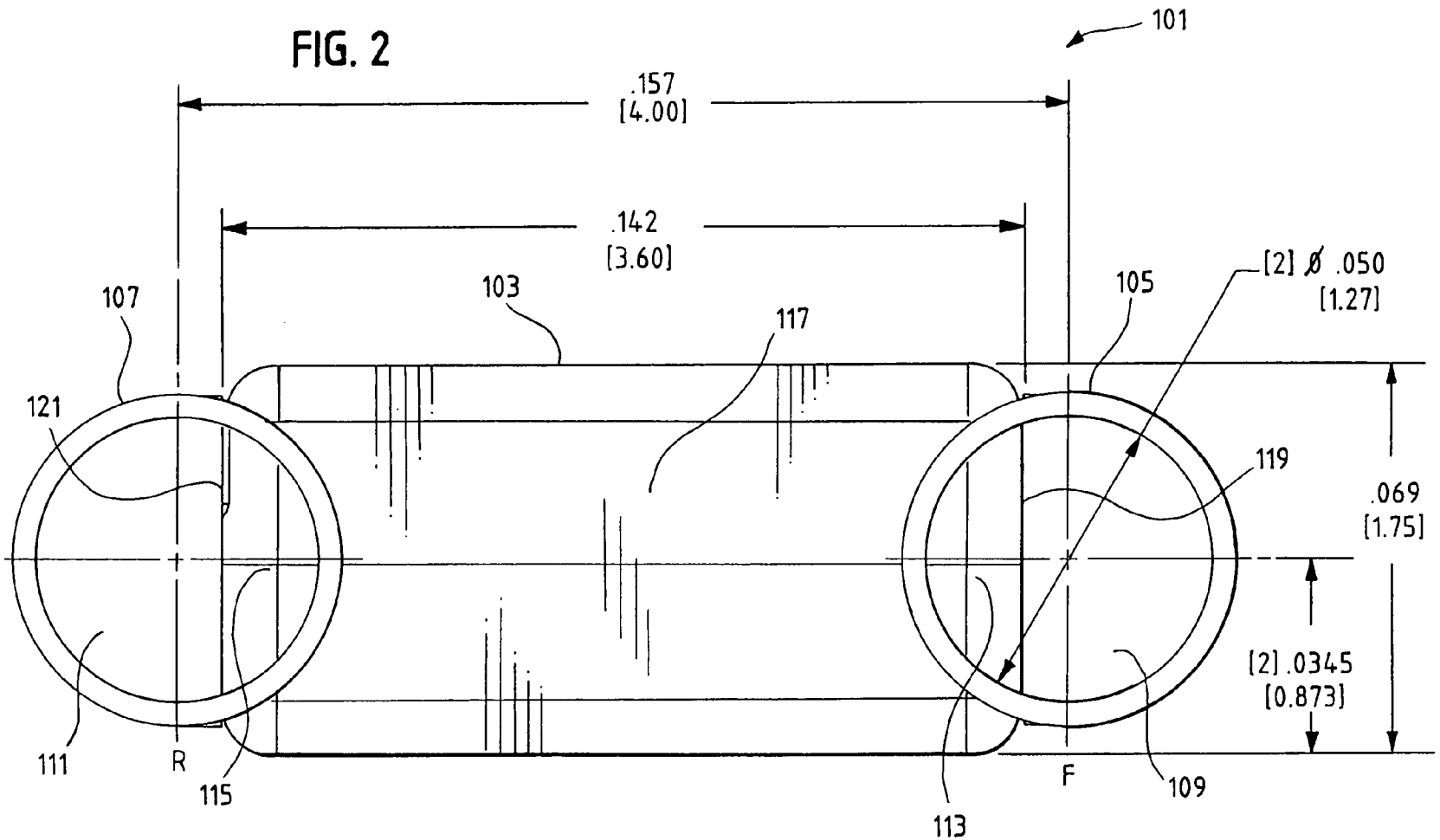
FIG. 2 is a top view of the directional microphone assembly of FIG. 1.

FIG. 2 is a top view of the directional microphone assembly 101 of FIG. 1. As can be seen from FIG. 2 by looking into inlets 109 and 111, portions 113 and 115 of directional microphone cartridge 103 extend partially into ducts 105 and 107, respectively, as mentioned above. In other words, the inside volume of the sound passages created by ducts 105 and 107 is formed in part by surfaces of the directional microphone cartridge 103. More specifically, the sound passage created by duct 105 has an inside volume formed in part by a portion of top surface 117 and a portion of side surface 119 of directional microphone cartridge 103. Similarly, the sound passage created by duct 107 has an inside volume formed in part by a portion of top surface 117 and a portion of side surface 121 of directional microphone cartridge 103.

Thus, in the configuration of FIGS. 1 and 2, the sound passages created by the ducts have an inner volume formed by inside surfaces of the ducts and by surfaces of the directional microphone cartridge. Such a configuration enables the directional microphone assembly 101 to have a smaller overall length dimension than if the sound passages had inside volumes formed only by inside surfaces of the sound ducts themselves.

Figure 3:
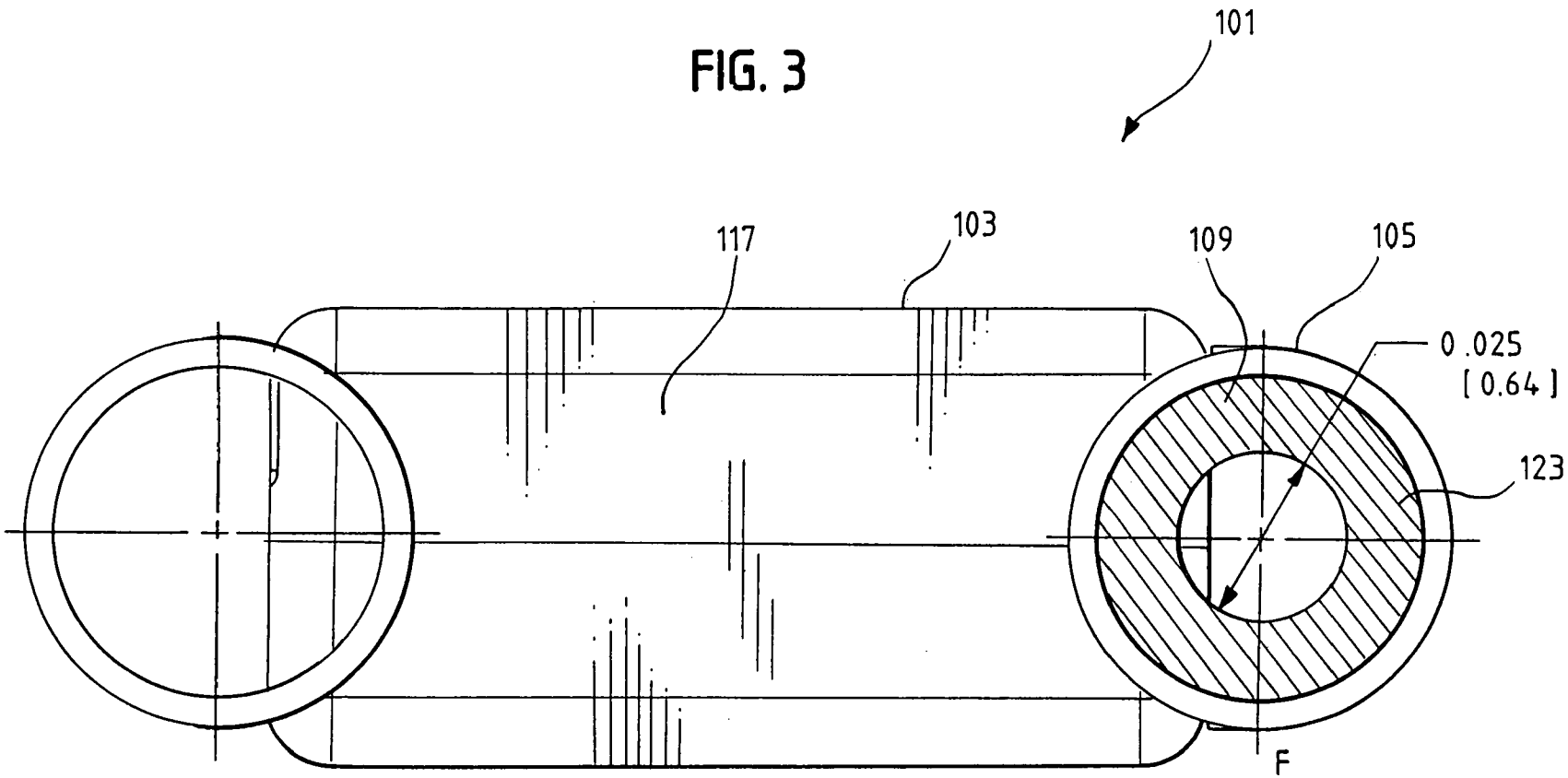
FIG. 3 is a top view of the directional microphone assembly of FIG. 1 showing a restrictor placed in a top portion of a (front) sound duct.

FIG. 3 is a top view of the directional microphone assembly 101 of FIG. 1 showing a restrictor 123 placed in a top portion of (front) sound duct 105. The restrictor 123 may be inserted into inlet 109 of sound duct 105 in a friction fit manner so that the restrictor 123 is flush with the top surface 117 of the directional microphone cartridge 103. Of course, other placements of the restrictor 123 are also possible. The restrictor 123 may be made of PVC tubing, for example, and may be used when it is desired to increase the acoustical inertance of the sound passage formed by (front) sound duct 105.

Figure 4:
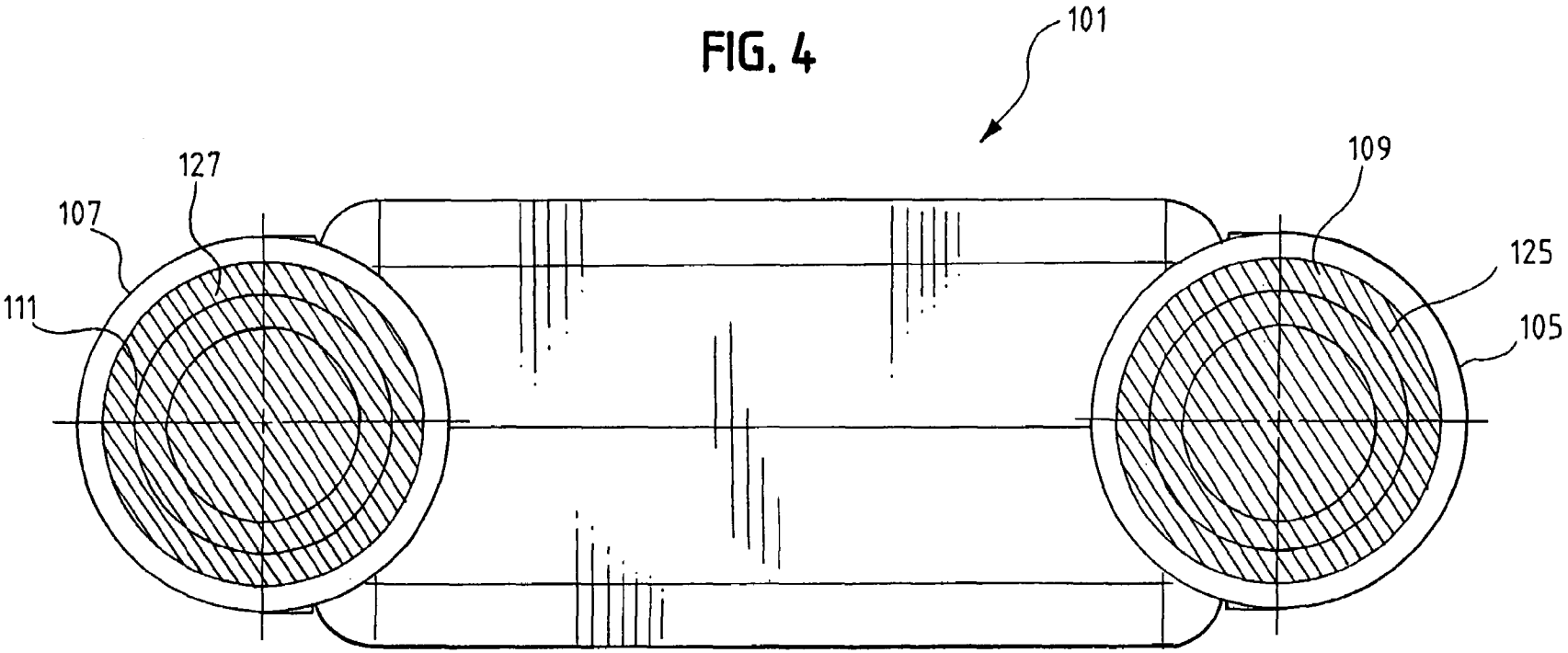
FIG. 4 is a top view of the directional microphone assembly of FIG. 1 showing acoustic dampers placed in top portions of sound ducts.

FIG. 4 is a top view of the directional microphone assembly 101 showing acoustic dampers 125 and 127 placed in top portions of sound ducts 105 and 107, respectively. The dampers 125 and 127 may also be inserted into inlets 109 and 111, respectively, of sound ducts 105 and 107 in a friction fit manner.

Figure 5:
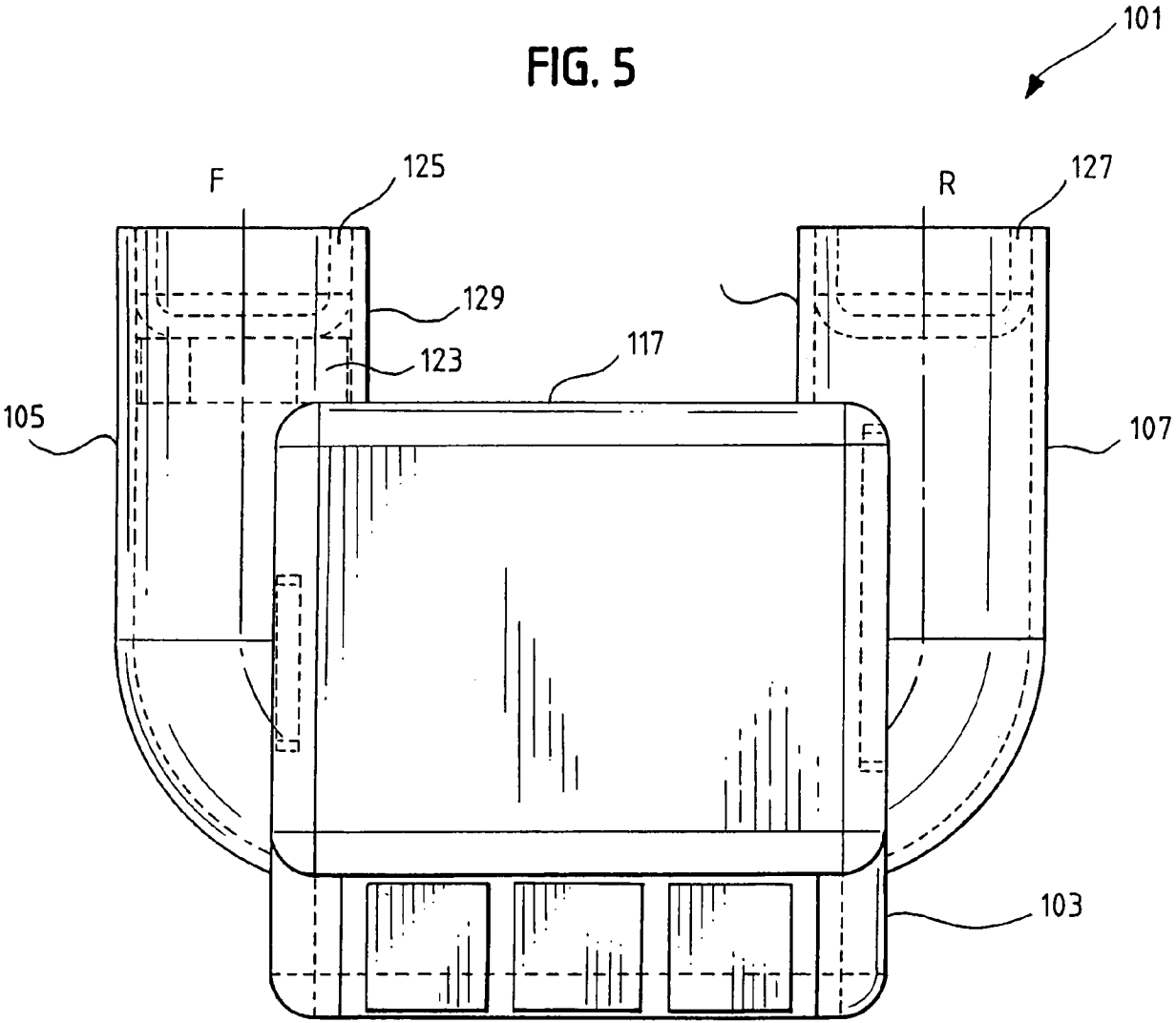
FIG. 5 is a side view of the directional microphone assembly of FIG. 1 showing both the restrictor and the acoustic dampers and in an assembled relationship.

FIG. 5 is a side view of the directional microphone assembly 101 of FIG. 1 showing both the restrictor 123 and the acoustic dampers 125 and 127 in an assembled relationship. As can be seen, restrictor 123 is located within an upper portion 129 of sound duct 105 so that it is flush with the top surface 117 of directional microphone cartridge 103. Damper 125 is also located within the upper portion 129 of sound duct 105 so that it is flush with a top surface of restrictor 123. Damper 127 is similarly located within an upper portion 131 of sound duct 107. Dampers 125 and 127 may be cup-shaped, as shown, may be made of a woven mesh-type material, such as metal, for example, and may have values of 680 ohms and 680 ohms, for example. Of course, the dampers 125 and 127 may be shaped differently, may be made of other types of material (e.g., cloth or polyester), and may have different values and still fall within the scope of the present invention. In addition, the dampers 125 and 127 may be placed in other locations, such as, for example, at the front and rear sound inlet ports or openings of directional microphone cartridge 103, respectively.

Figure 6:
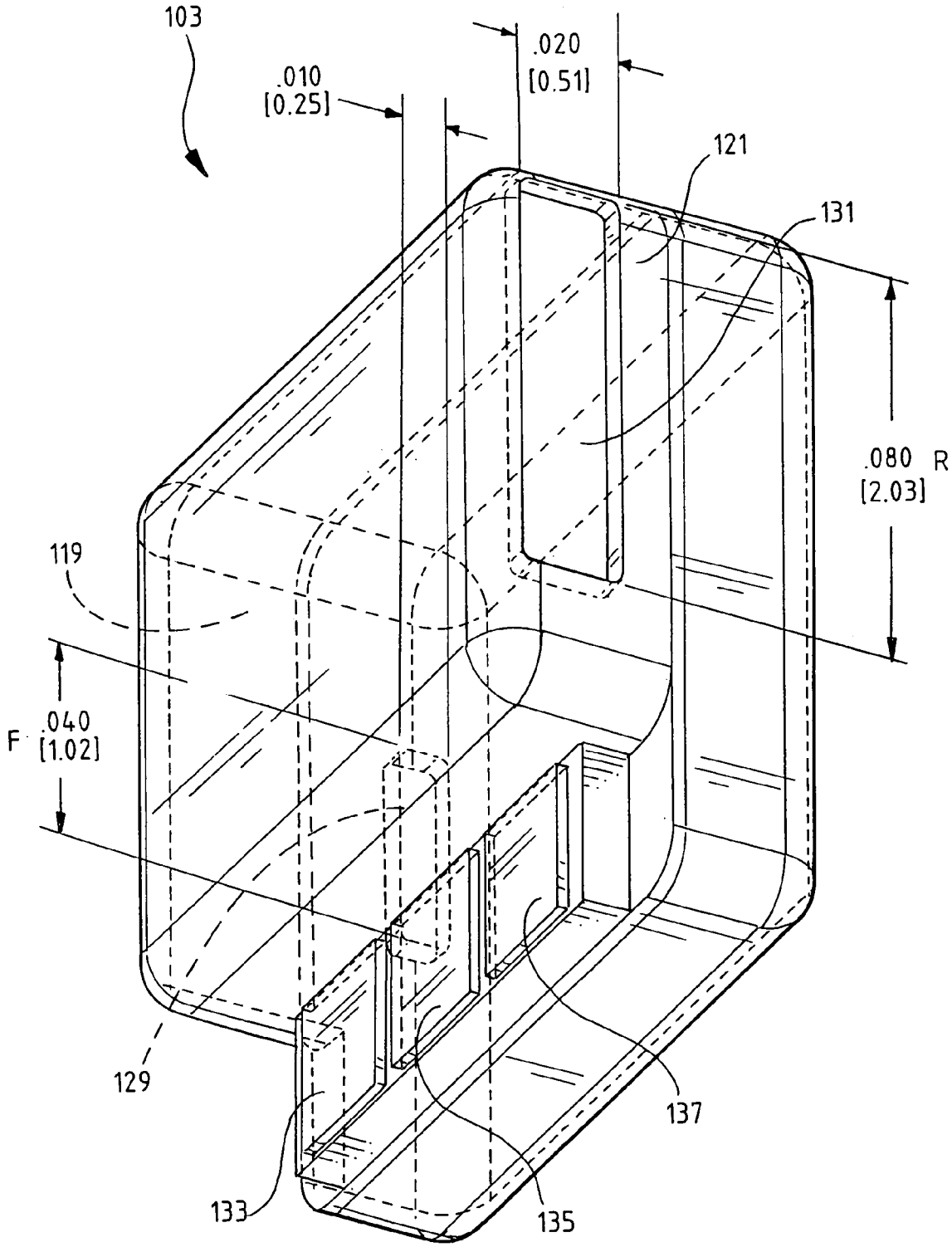
FIG. 6 illustrates one embodiment of directional microphone cartridge of the directional microphone assembly of the present invention.

FIG. 6 illustrates one embodiment of the directional microphone cartridge 103 of the directional microphone assembly of the present invention. A front sound inlet port or opening 129 is located at least partially on the side surface 119 of directional microphone cartridge 103, and a rear inlet port or opening 131 is located at least partially on the side surface 121 of directional microphone cartridge 123. The front sound inlet port 129 may have a length dimension of approximately 0.040 inches (1.02 mm) and a width dimension of approximately 0.010 inches (0.25 mm), for example, and the rear sound inlet port 131 may have a length dimension of approximately 0.080 inches (2.03 mm) and a width dimension of approximately 0.020 inches (0.51 mm), for example. Of course, the front and rear sound inlet ports 129 and 131 may have other dimensions and take on different shapes and still fall within the scope of the present invention.

In any case, the front sound inlet port 129 enables the acoustical coupling of sound to a front side of a diaphragm (not shown) located in the directional microphone cartridge 103, and the rear sound inlet port 131 likewise enables the acoustical coupling of sound to a rear side of that diaphragm. Upon assembly of a system such as directional microphone assembly 101 described above, sound ducts 105 and 107 cover sound inlet ports 129 and 131, respectively, as explained more completely below.

Also as explained more completely below, directional microphone cartridge 103 includes three contacts 133, 135 and 137 for electrically connecting to an equalization circuit or other hearing aid circuitry, such as, for example, a hearing aid amplifier.

Figure 7:
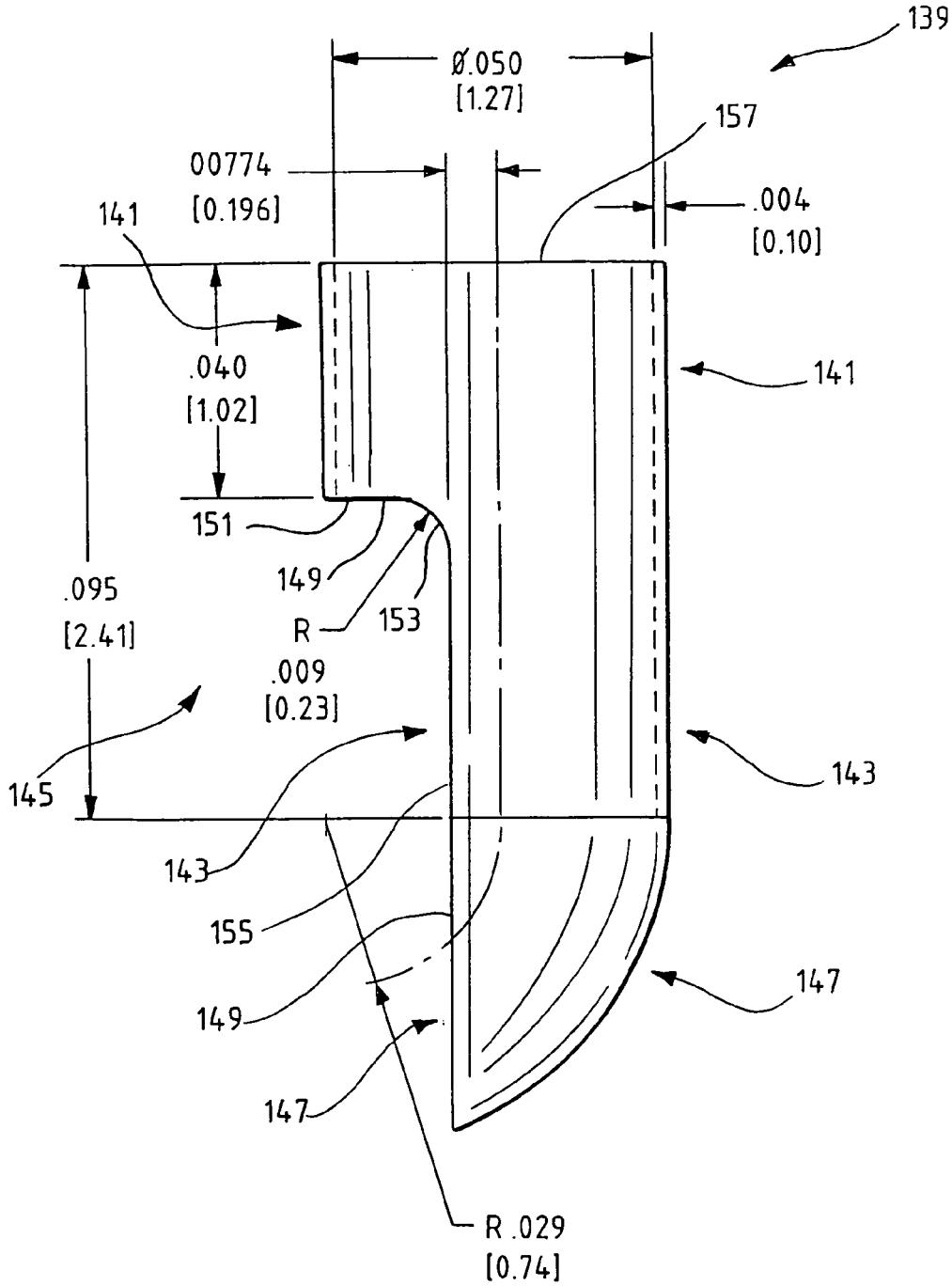
FIG. 7 illustrates one embodiment of a sound duct in accordance with the present invention.

FIG. 7 illustrates one embodiment of a sound duct in accordance with the present invention. Sound duct 139 as shown in FIG. 7 is the same as the sound ducts 105 and 107 illustrated above with respect to directional microphone assembly 101. As can be seen from the figures, sound duct 139 has a top portion 141 having a generally circular cylindrical shape. Sound duct 139 also has a middle portion 143 having a cut-away area 145, such that middle portion 143 has only a semi-circular cylindrical shape. Finally, sound duct 139 further has a bottom portion 147 having a partial, non-circular sphere-like shape.

Sound duct 139 is mounted on a directional microphone cartridge, such as, for example, directional microphone cartridge 103 discussed above, by fitting the cut-away portion 145 against the directional microphone cartridge. In other words, sound duct 139 has a mating surface 149 that rests at least partially against the directional microphone cartridge. More specifically, a portion 151 of mating surface 149 rests on a top surface of the directional microphone cartridge, a curved portion 153 of mating surface 149 rests on a curved portion of the directional microphone cartridge, and a further portion 155 of mating surface 149 rests on a side surface of the directional microphone cartridge. Thus, the junction between the mating surface 149 of sound duct 139 and the outer surfaces of the directional microphone cartridge generally forms a shape on the outer surfaces of the directional microphone cartridge that completely surrounds the sound port or opening located on the side surface of the directional microphone cartridge (see FIG. 8). Thus, only sound entering inlet 157 is acoustically coupled to the diaphragm of the directional microphone cartridge.

Sound duct 139 may be attached to the directional microphone cartridge by use of epoxy or other adhesive at the junction between the surface 149 of the sound duct 139 and the relevant outer surfaces of the directional microphone cartridge. Once it is attached to the directional microphone cartridge, the sound duct 139 creates a sound passage to the port in the cartridge having a volume formed by an inner surface of the sound duct 139 and outer surfaces of the directional microphone cartridge, as discussed above.

Figure 8:
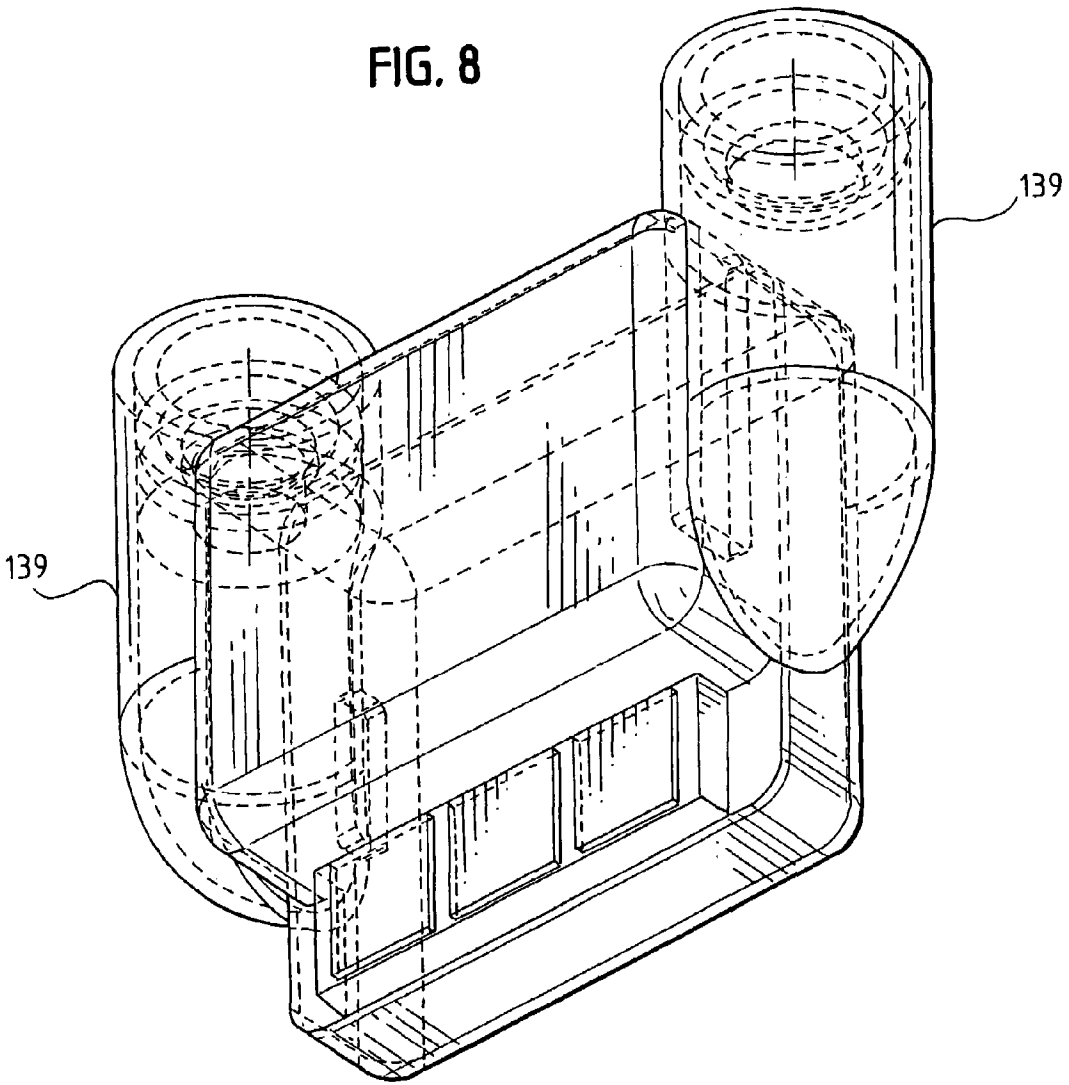
FIG. 8 illustrates additional detail regarding the mounting of the sound duct of FIG. 7 on a directional microphone cartridge.

FIG. 8 illustrates additional detail regarding the mounting of sound duct 139 on a directional microphone cartridge.

While sound duct 139 is shown as having the shape generally described above with respect to FIG. 7, duct 139 may of course have other shapes and still fall within the scope of the present invention. For example, the sound duct of the present invention may generally have a non-circular cylindrical shape, such as rectangular. It also may have a generally uniform radial dimension along its length, so that it has only two portions defining its overall shape rather than the three portions (141, 143 and 147) discussed above with respect to sound duct 139 of FIG. 7.

Figure 9:
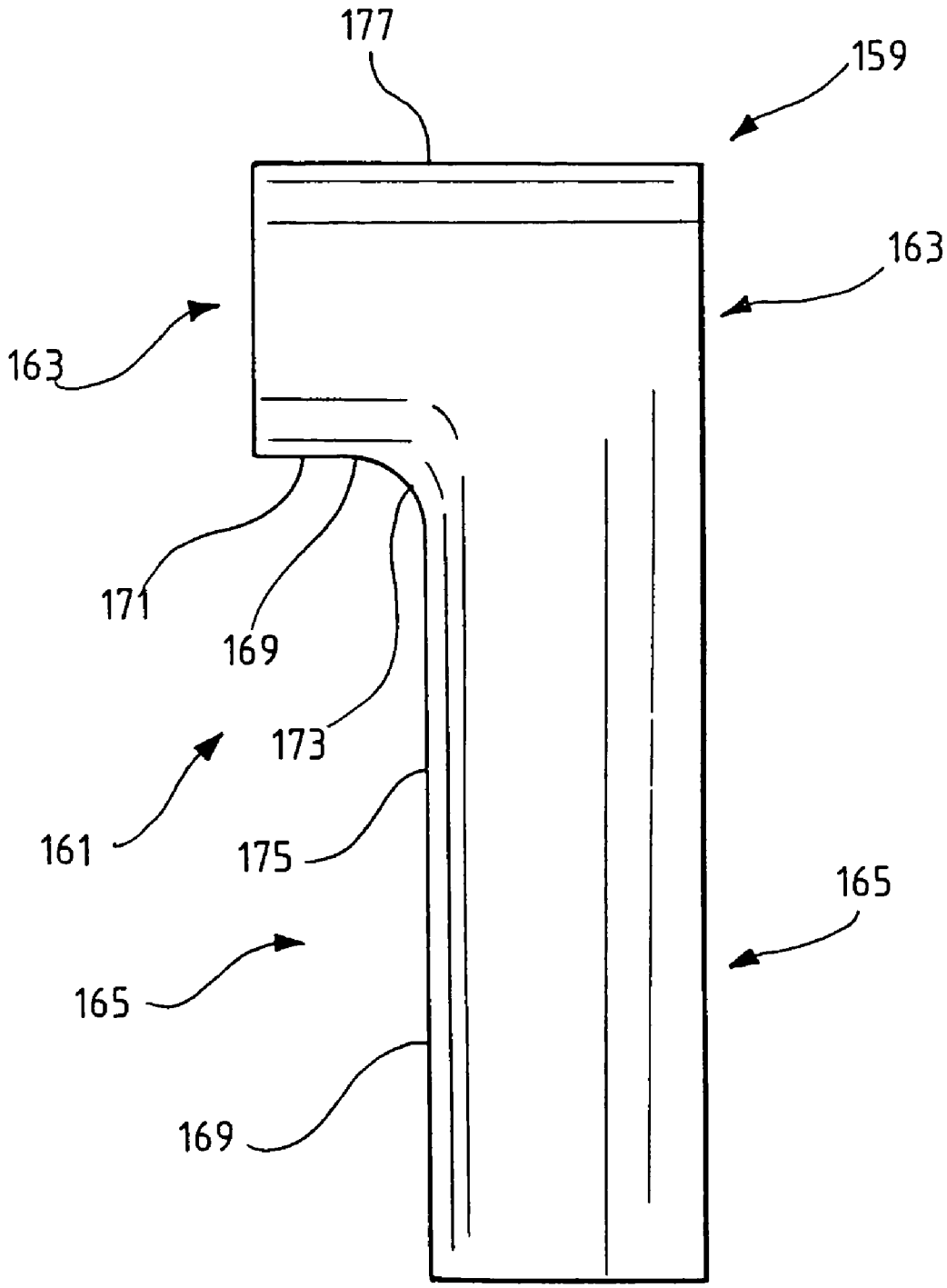
FIG. 9 illustrates another embodiment of a sound duct in accordance with the present invention.

FIG. 9 illustrates another embodiment of a sound duct in accordance with the present invention, having such a generally uniform radial dimension along its length. More specifically, sound duct 159 has a generally circular cylindrical shape along its length, but for cut-away area 161. As can be seen, sound duct 159 has a top portion 163 having a generally circular cylindrical shape, and a bottom portion 165 having only a semi-circular cylindrical shape. Thus, sound duct 159 has only two portions 163 and 165 defining its overall shape, rather than the three portions (141, 143 and 147) discussed above with respect to the shape of sound duct 139 of FIG. 7.

Sound duct 159, like sound duct 139 of FIG. 7, is mounted on a directional microphone cartridge, such as, for example, directional microphone cartridge 103 discussed above, by fitting the cut-away portion 161 against the directional microphone cartridge. Sound duct 159 similarly has a mating surface 169 that rests at least partially against the directional microphone cartridge. A portion 171 of mating surface 169 rests on a top surface of the directional microphone cartridge, a curved portion 173 of mating surface 169 rests on a curved portion of the directional microphone cartridge, and a further portion 175 of mating surface 169 rests on a side surface of the directional microphone cartridge. Again, the junction between the mating surface 169 of sound duct 159 and the surfaces of the directional microphone cartridge generally forms a shape on the outer surfaces of the directional microphone cartridge that completely surrounds the sound port or opening located on the side surface of the directional microphone cartridge. Only sound entering inlet 177 is acoustically coupled to the diaphragm of the directional microphone cartridge.

Similar to sound duct 139 of FIG. 7, sound duct 159 may be attached to the directional microphone cartridge by use of epoxy or other adhesive at the junction between the surface 169 of the sound duct 159 and the relevant outer surfaces of the directional microphone cartridge. When attached, the sound duct 159 likewise creates a sound passage to the port in the cartridge having a volume formed by an inner surface of sound duct 159 and outer surfaces of the directional microphone cartridge, as discussed above. Sound duct 159 may be simply machined from a circular, cylindrical tube, and may have dimensions similar to those of sound duct 139.

Figure 10:
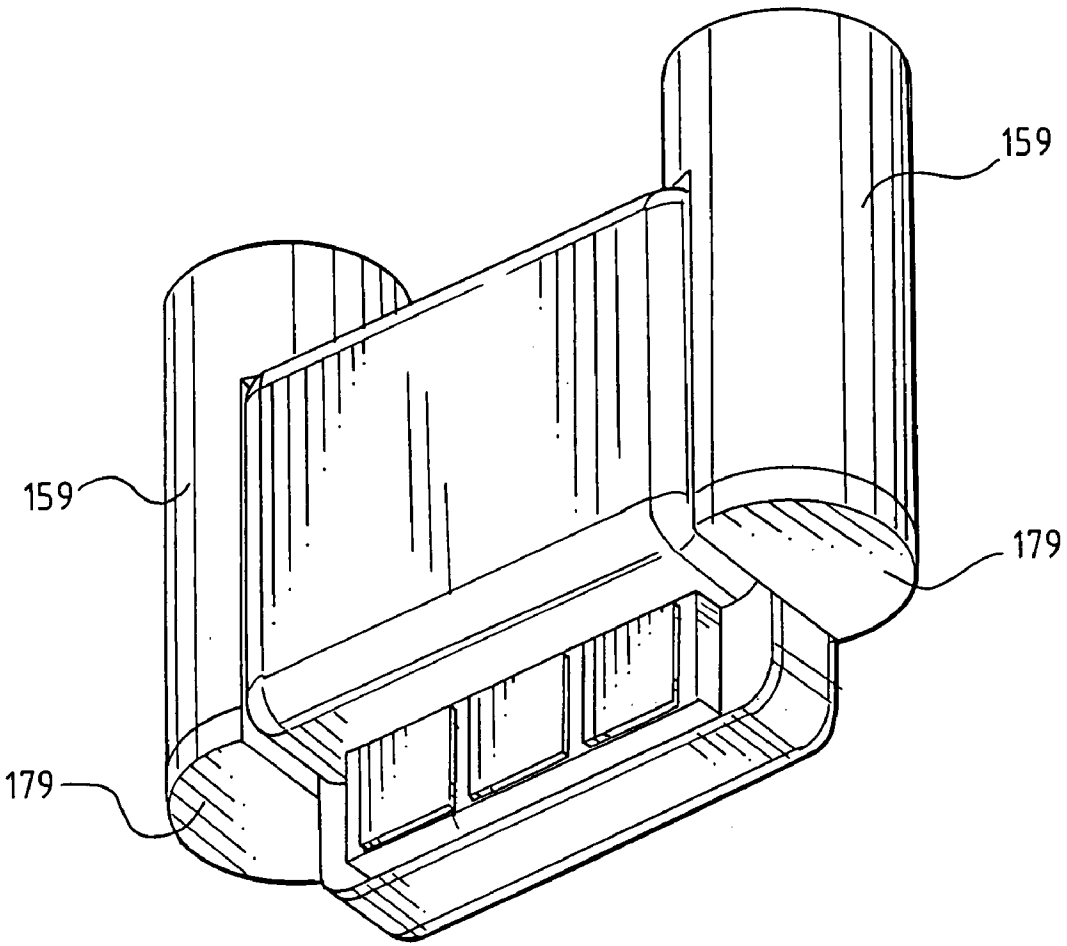
FIG. 10 illustrates additional detail regarding the mounting of the sound duct of FIG. 9 on a directional microphone cartridge.

FIG. 10 illustrates additional detail regarding the mounting of sound duct 159 on a directional microphone cartridge. If, for example, sound duct 159 is machined from a circular cylindrical tube as suggested above, plugs 179 may be used to close open bottom ends of the sound duct 159. Plugs 179 may, for example, be press fit within the open bottom ends of sound ducts 159, or may be attached to the open bottom ends of sound ducts 159 using epoxy or other adhesive material.

Figure 11:
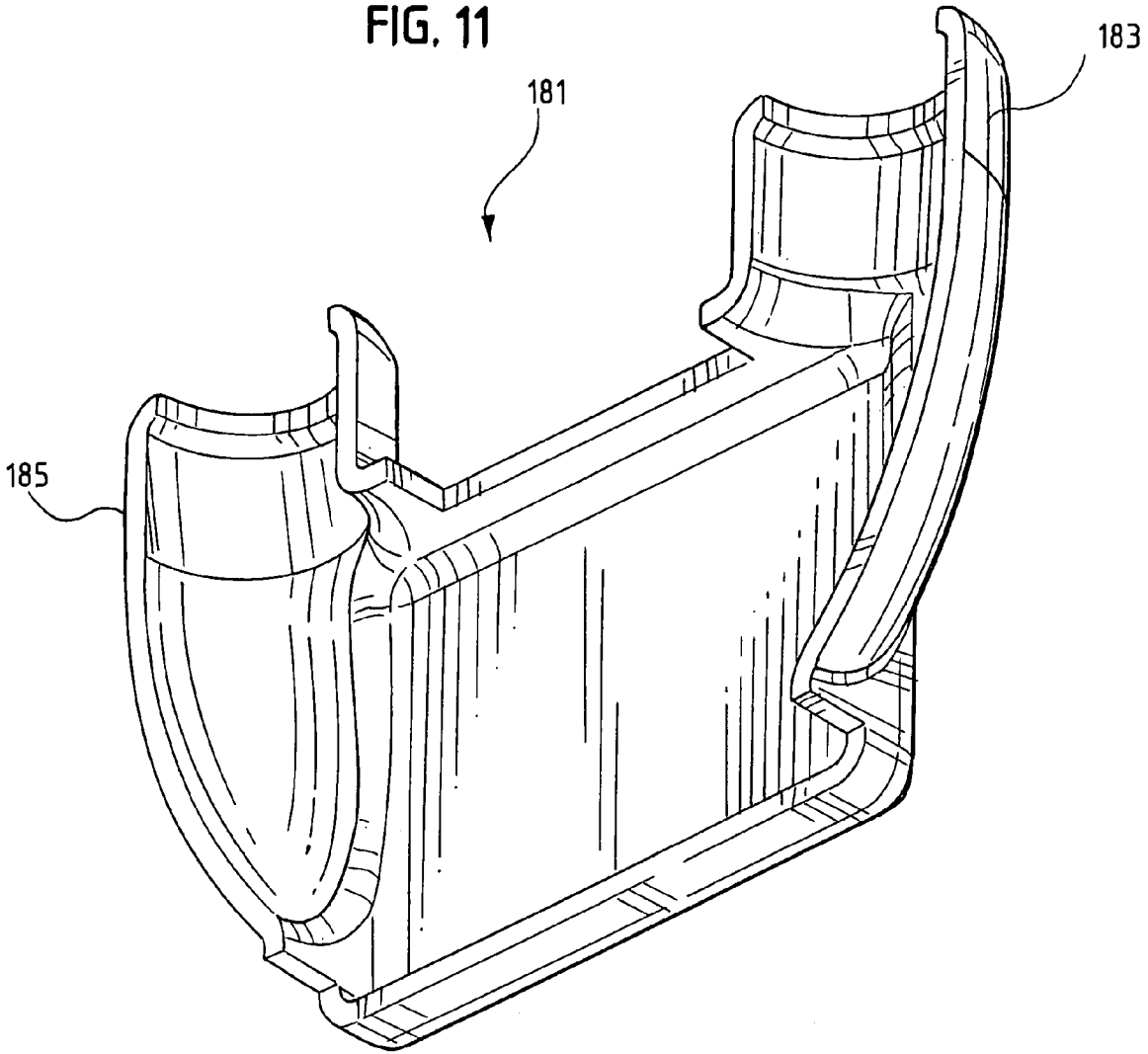
FIG. 11 illustrates a directional microphone cartridge housing portion having sound duct portions formed as an integral part of the housing portion.
Figure 12:
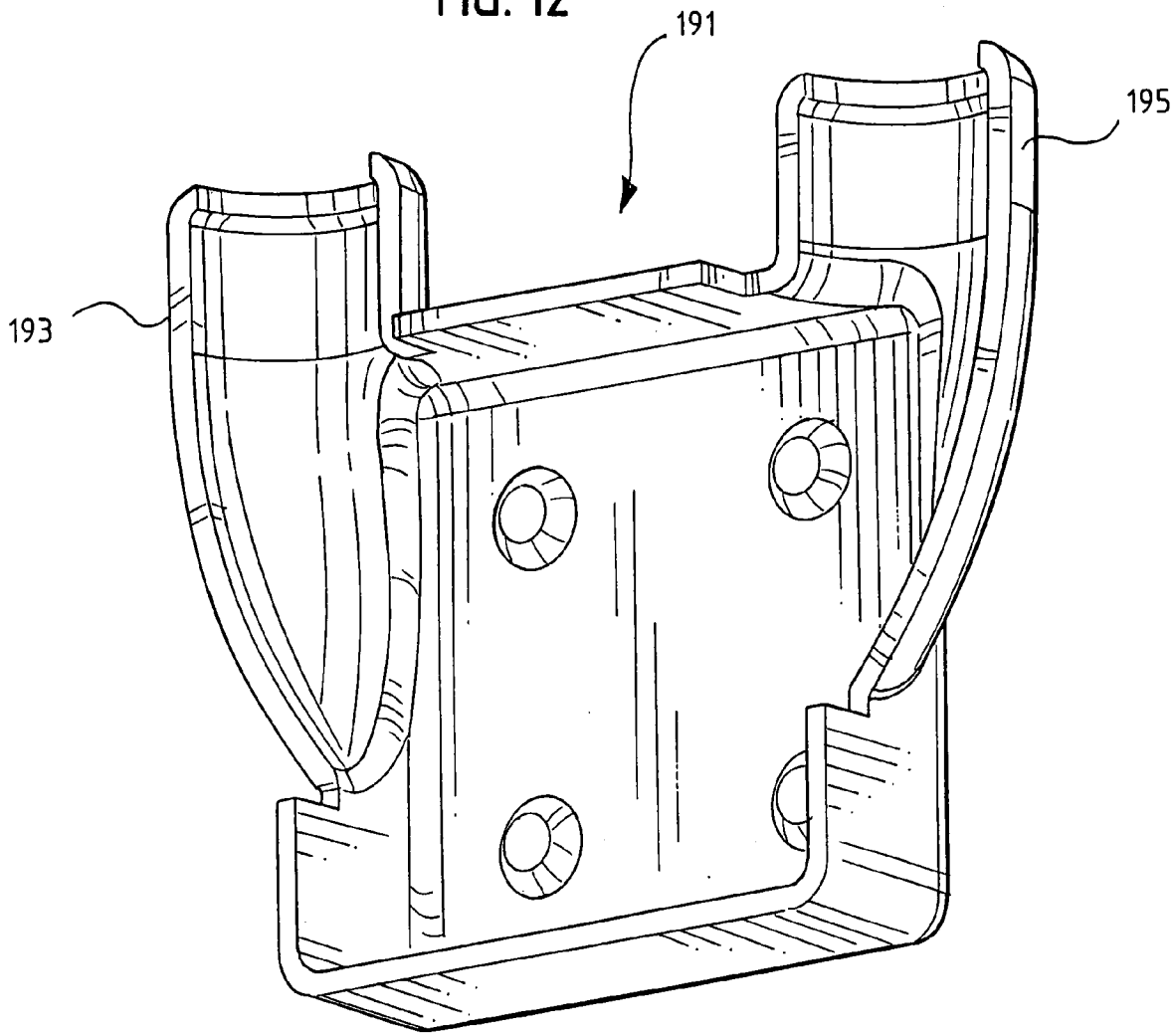
FIG. 12 illustrates another directional microphone cartridge housing portion having sound duct portions formed as an integral part of the housing portion.

While the sound ducts discussed above are shown to be components that are separate and distinct from the directional microphone cartridge, they may also be formed as an integral part of the directional microphone cartridge housing. For example, FIG. 11 illustrates a directional microphone cartridge housing portion or half 181 having sound duct portions 183 and 185 formed as an integral part of housing portion 181. FIG. 12 similarly illustrates another directional microphone cartridge housing portion or half 191 housing sound duct portions 193 and 195 formed as an integral part of housing portion 191.

Figure 13:
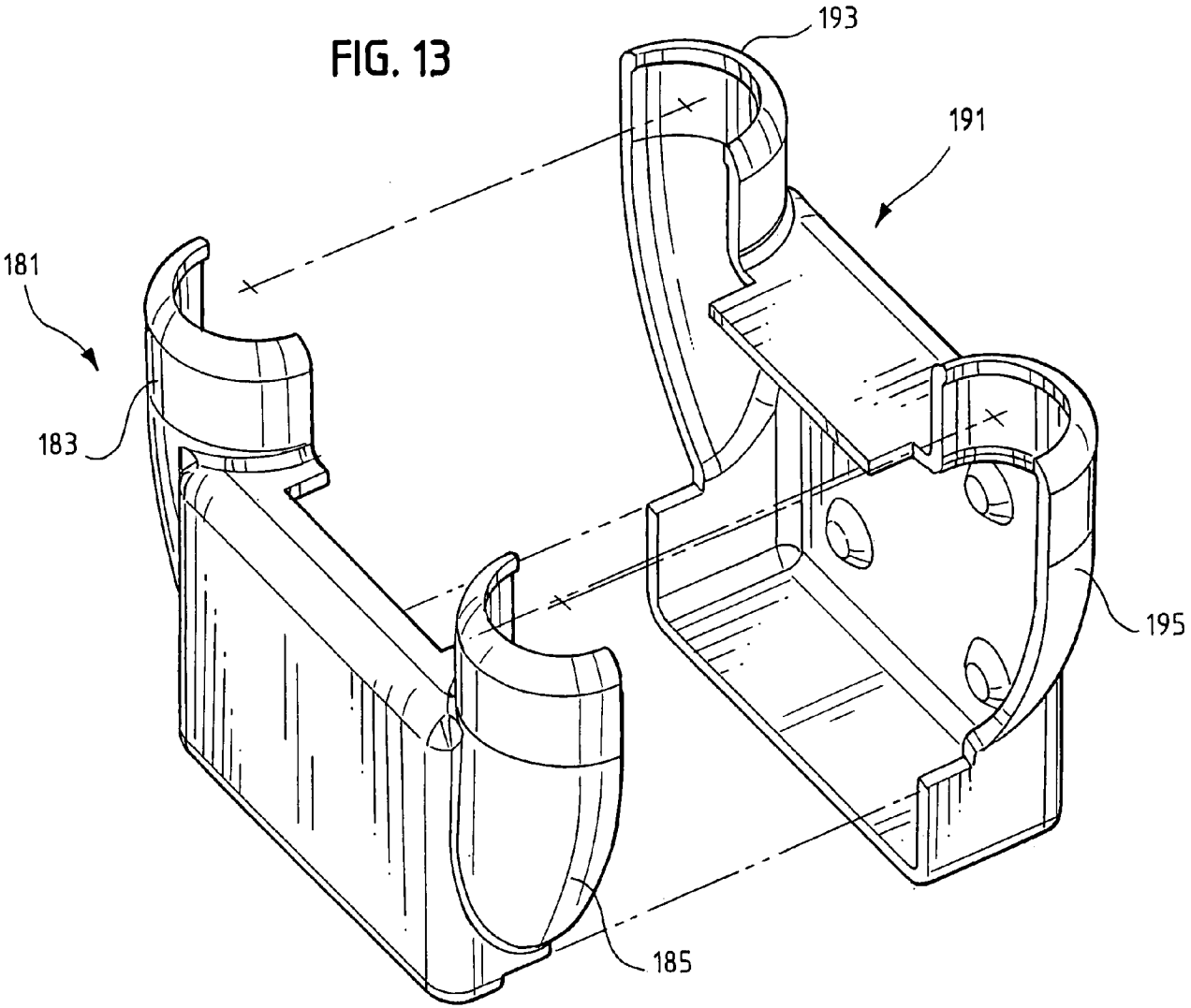
FIG. 13 illustrates an assembly technique for the housing portions of FIGS. 11 and 12.

The housing portions 181 and 191 may be assembled by bringing them together until corresponding mating surfaces on housing portions 181 and 191 engage to form a complete directional microphone cartridge housing having integrated sound ducts. FIG. 13 illustrates such an assembly technique. As can be seen, sound duct portion 183 of housing portion 181 engages sound duct portion 193 of housing portion 191 to form one complete sound duct. Similarly, sound duct portion 185 of housing portion 181 engages sound duct portion 195 of housing portion 191 to form another complete sound duct.

Figure 14:
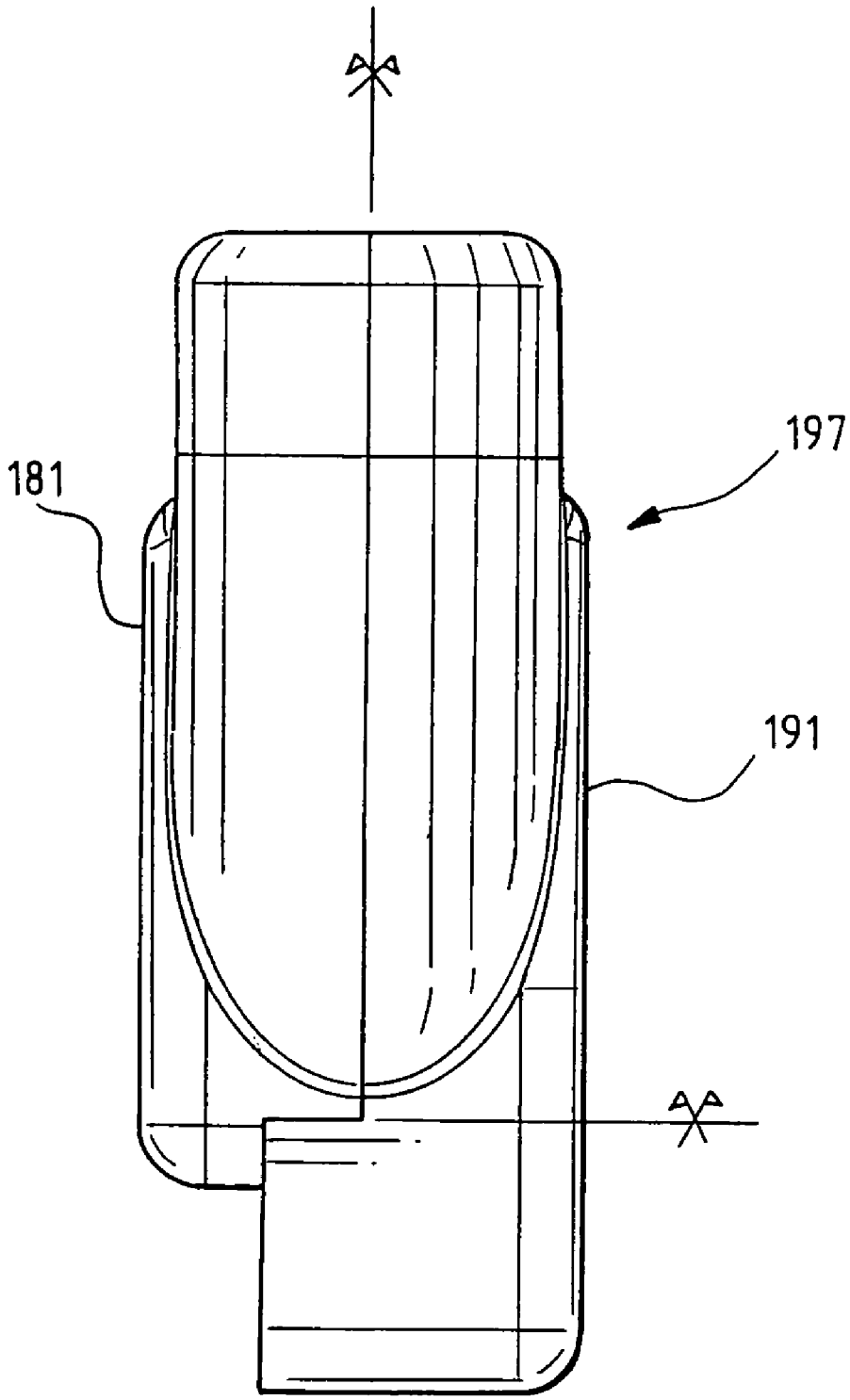
FIG. 14 illustrates a completed assembly, in which the housing portions if

FIG. 14 illustrates a completed assembly, in which housing portions 181 and 191 are engaged to form a complete directional microphone cartridge 197 having integrated sound ducts. Housing portions 181 and 191 may be snap-fit together or may be held together using epoxy or other adhesive material, for example. Of course, the housing portions and sound duct portions may take different shapes than as shown in FIGS. 11-14, so that different sound duct, cartridge housing, cartridge port, etc., configurations may be implemented if desired.

Figure 15:
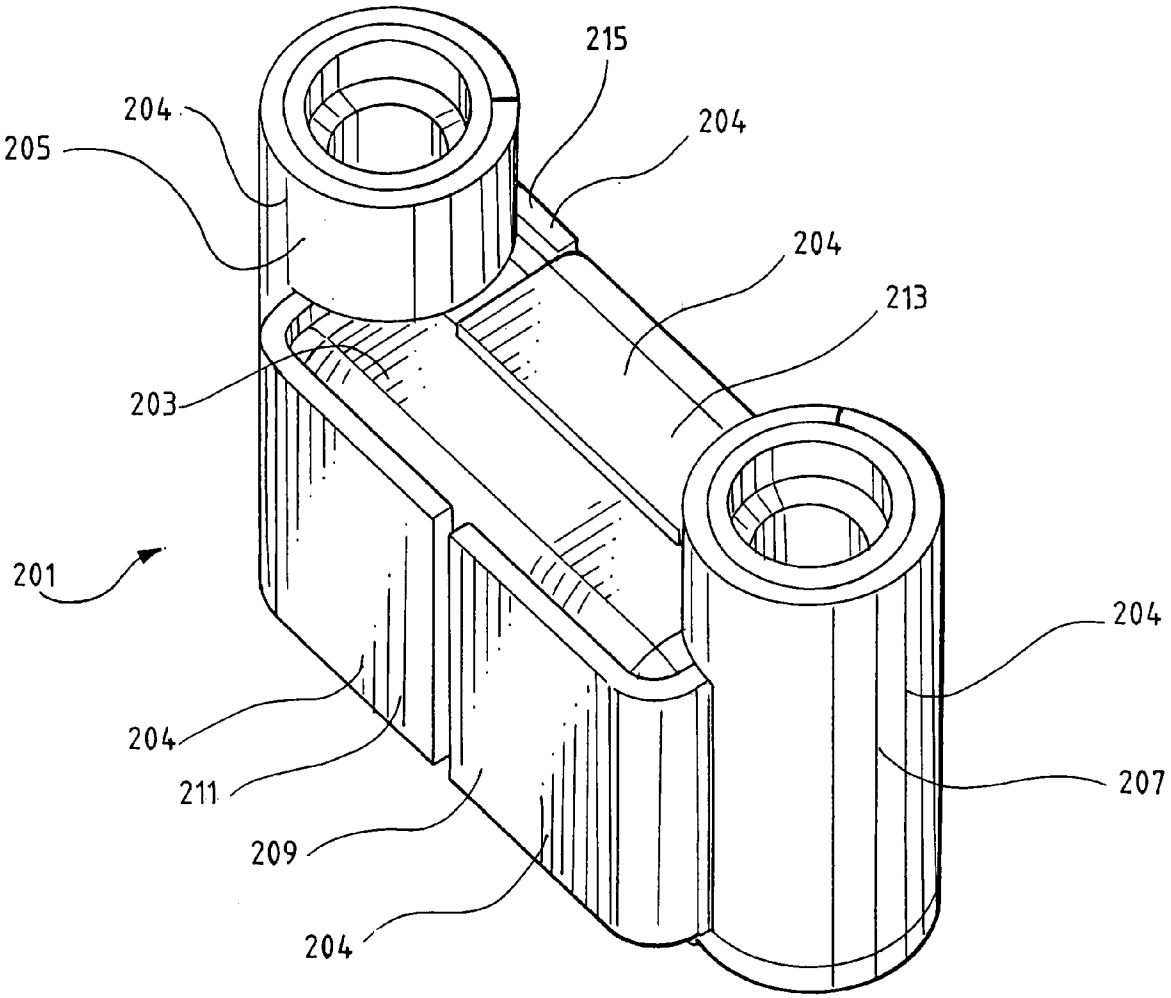
FIG. 15 illustrates an alternate embodiment of a directional microphone assembly of the present invention.

FIG. 15 illustrates an alternate embodiment of a directional microphone assembly of the present invention. Directional microphone assembly 201 comprises a directional microphone cartridge 203 and a sound duct assembly 204. Sound duct assembly 204 may be formed from a single sheet of material, such as metal, for example. More specifically, a sheet of material is cut and shaped to create sound ducts 205 and 207, as well as mounting members 209, 211, 213 and 215. Another mounting member (not shown), corresponding to mounting member 215 adjacent sound duct 205, is likewise located adjacent sound duct 207.

During assembly, the directional microphone cartridge 203 is positioned between the sound ducts 205 and 207 of sound duct assembly 204, and the mounting members (including mounting members 209, 211, 213 and 215) of sound duct assembly 204 are wrapped around the directional microphone cartridge 203 to hold the sound ducts 205 and 207 in place. In other words, the sound duct assembly 204 "hugs" the directional microphone cartridge 203. Epoxy or other adhesive material, for example, may also be used to secure the sound duct assembly 204 with the directional microphone cartridge.

Figure 16:
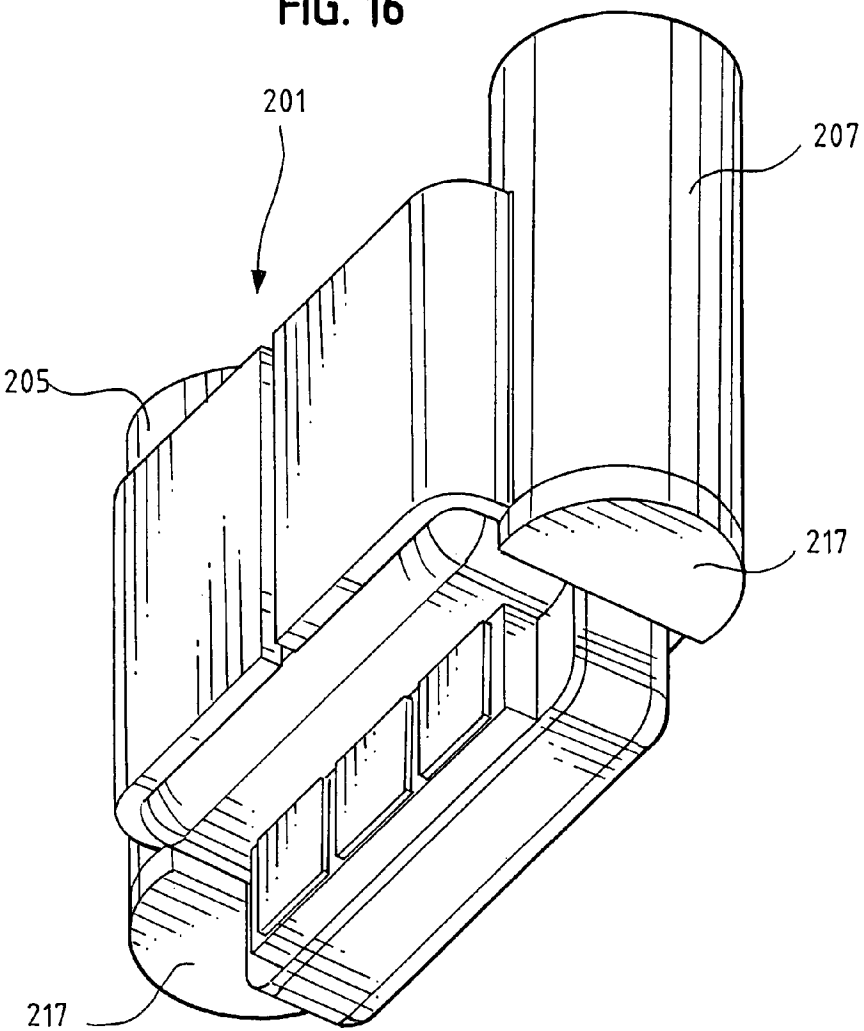
FIG. 16 is another view of the directional microphone assembly of FIG. 15.

FIG. 16 is another view of the directional microphone assembly of FIG. 15. Similarly as discussed above with respect to FIG. 10, plugs 217 may be used to close open bottom ends of the sound ducts 205 and 207 as shown. Again, plugs 217 may, for example, be press fit within the open bottom ends of sound ducts 205 and 207, or be attached to the open bottom ends of sound ducts 205 and 207 using epoxy or other adhesive material.

Figure 17:
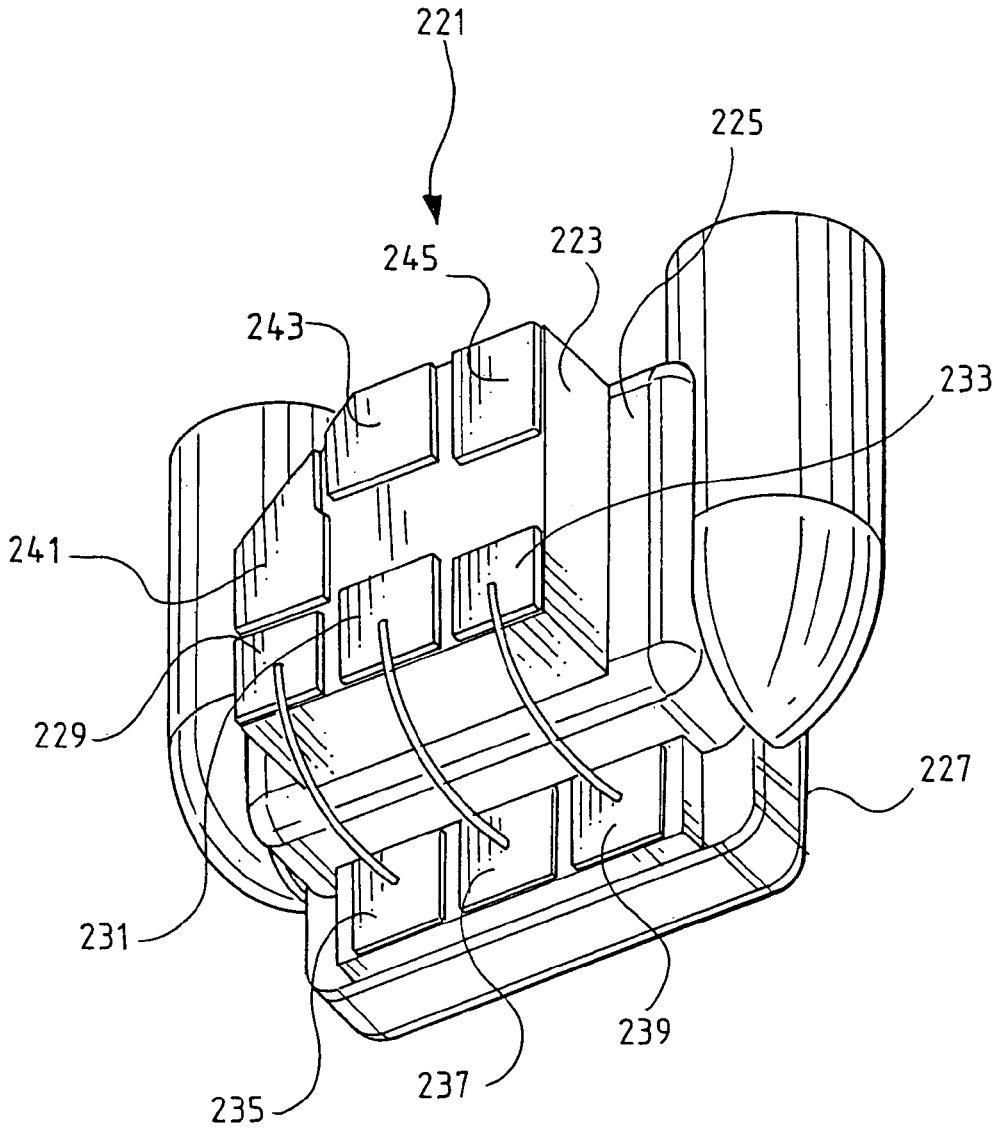
FIG. 17 illustrates a directional microphone assembly of the present invention having an equalization hybrid.

FIG. 17 illustrates a directional microphone assembly of the present invention having an equalization hybrid. Equalization may be used, if desired, to compensate for low frequency roll-off and to provide a flat response similar to that of an omnidirectional hearing aid microphone. Directional microphone assembly 221 may be generally the same as directional microphone assembly 101 discussed above, for example, with the addition of an equalization hybrid 223 mounted on a side surface 225 of directional microphone cartridge 227. Equalization hybrid 223 includes three contacts 229, 231 and 233 for electrical connection with contacts 235, 237 and 239, respectively, of the directional microphone cartridge 227, as shown. Equalization hybrid 223 also includes contacts 241, 243 and 245 for electrical connection to hearing aid circuitry.

FIGS. 18A and 18B show exemplary details of the equalization hybrid 223. Hybrid 223 may have the dimensions and contact configurations as shown in FIGS. 18A and 18B.

FIG. 19 is a diagram illustrating an exemplary interconnection between the directional microphone cartridge 227 and the equalization hybrid 223. Equalization hybrid 223 includes, in addition to the contacts mentioned above with respect to FIGS. 17-18, an equalization die circuit 247. The equalization hybrid 223 may be an ER-82 EQ Hybrid, and the equalization die circuit 247 may be an ER-81 Die, both from Etymotic Research Inc.

Figure 20:
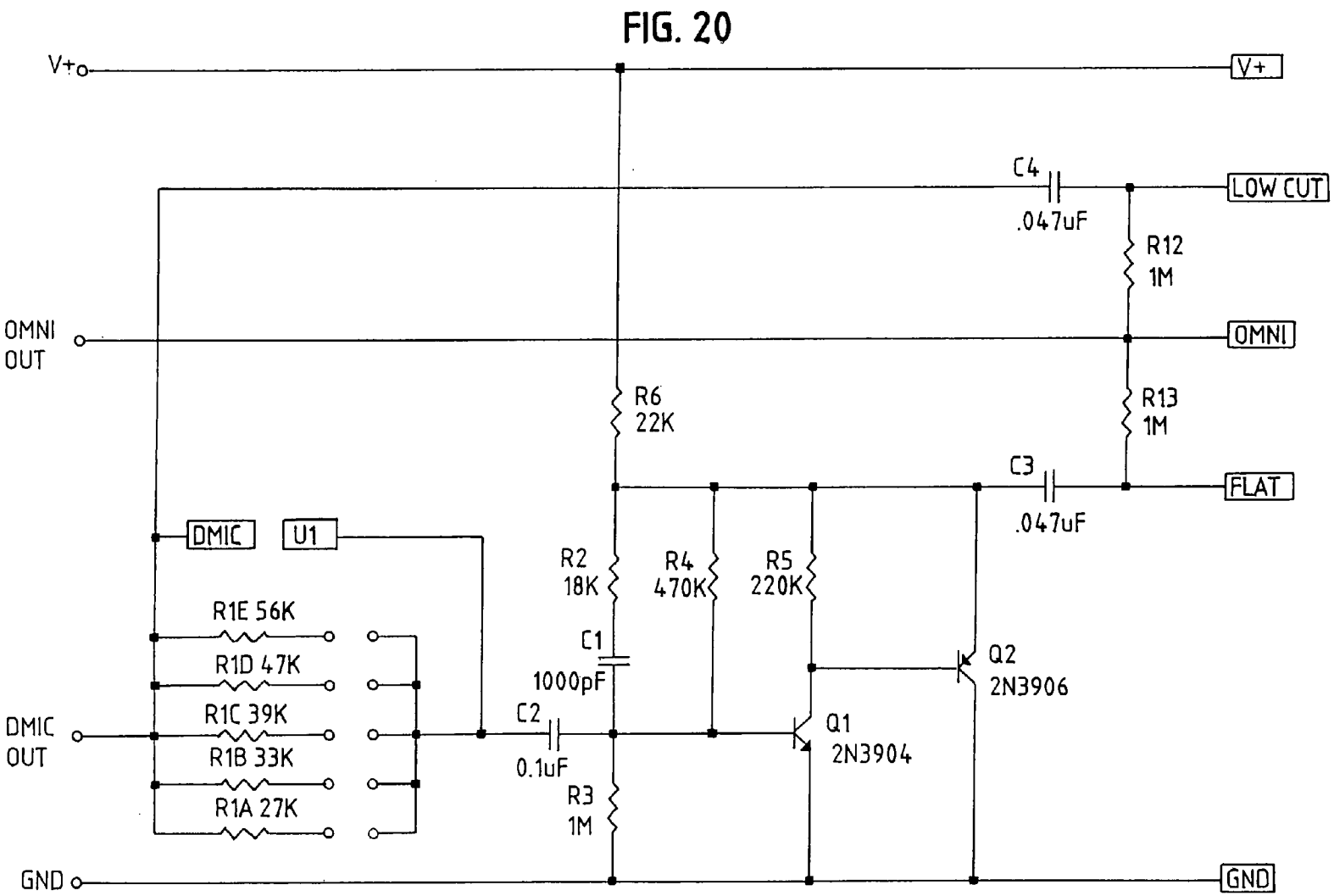
FIG. 20 is a circuit diagram illustrating exemplary circuitry for implementing equalization.

FIG. 20 is a circuit diagram illustrating exemplary circuitry for implementing equalization.

Figure 21:
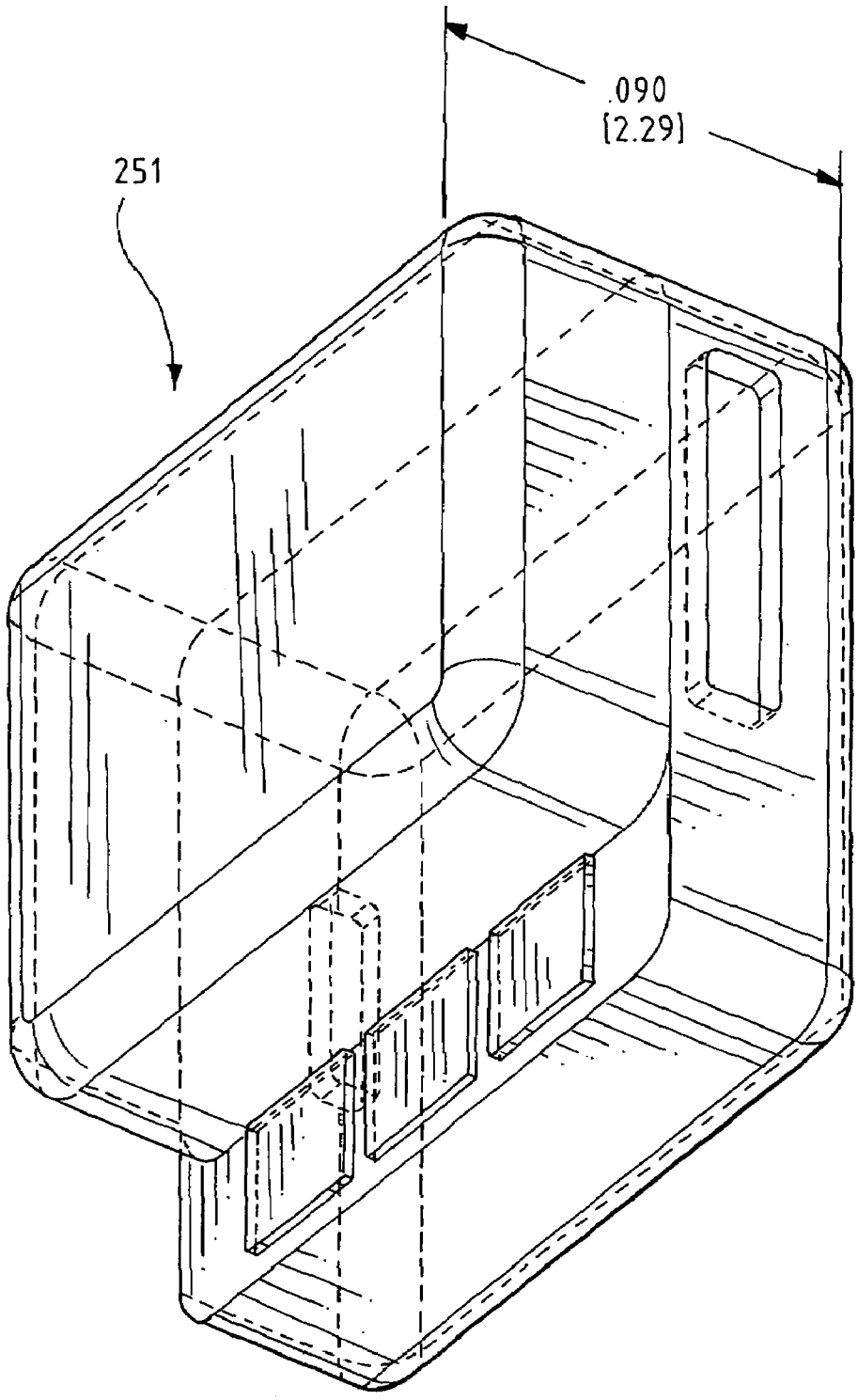
FIG. 21 illustrates a directional microphone cartridge having a larger housing volume to accommodate internal equalization circuitry.

While FIG. 17 shows the equalization circuitry mounted on the outside of the directional microphone cartridge, equalization circuitry may instead be located within the directional microphone cartridge. FIG. 21 illustrates a directional microphone cartridge having a larger housing volume to accommodate internal equalization circuitry. Specifically, directional microphone cartridge 251 has a thickness dimension of 0.090 inches (2.29 mm), for example, as shown in FIG. 21. Directional microphone cartridge 103 of directional microphone assembly 101, by comparison, has a thickness dimension of 0.069 inches (1.75 mm) (see FIG. 2). The additional space in directional microphone cartridge 251 is used to carry equalization circuitry.

Figure 22:
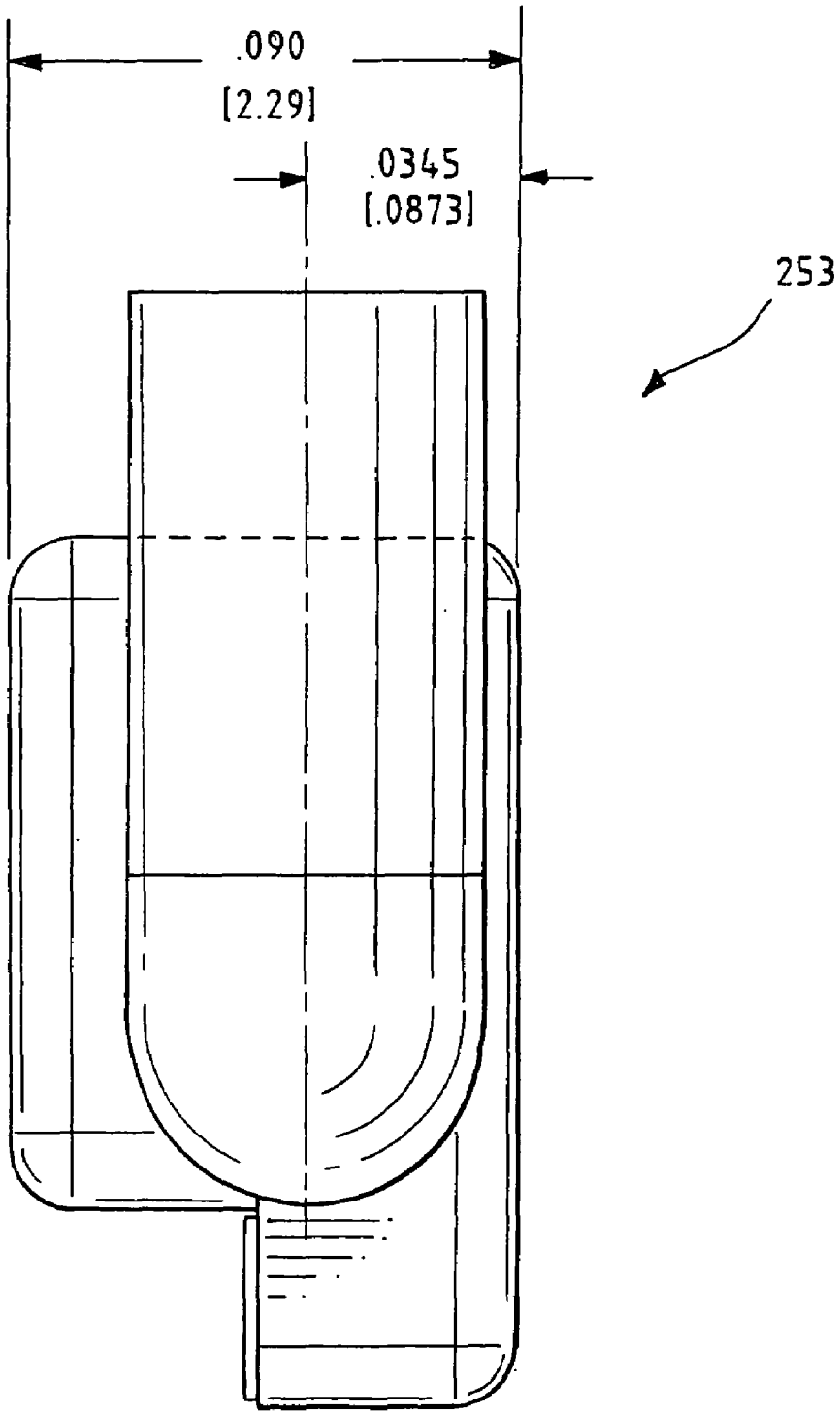
FIGS. 22 and 23 are side and perspective views, respectively, of a directional microphone assembly having internal equalization circuitry.
Figure 23:
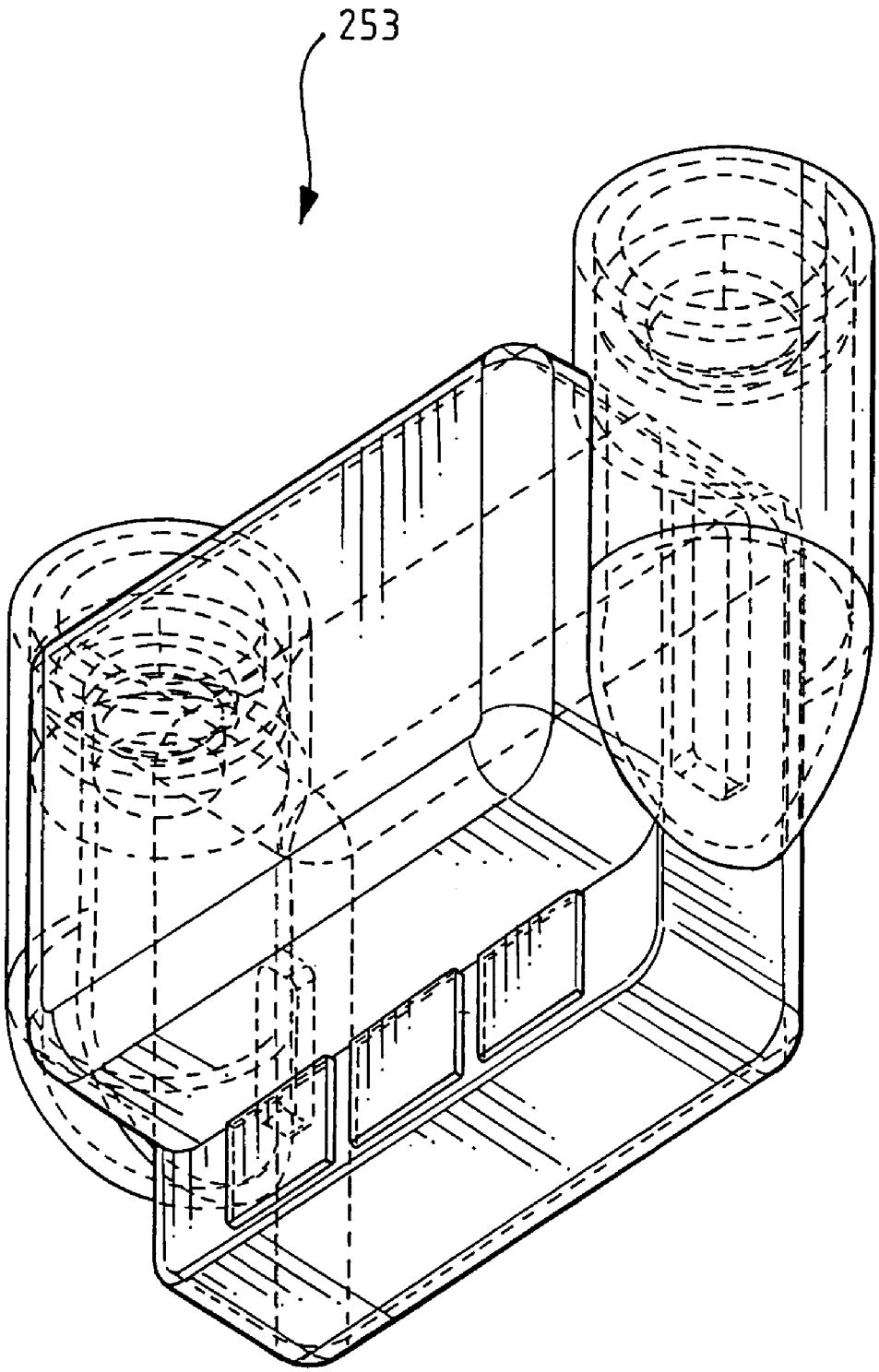

FIGS. 22 and 23 are side and perspective views, respectively, of a directional microphone assembly having internal equalization circuitry. Directional microphone assembly 253 is generally thicker than directional microphone assembly 101 discussed above. The thickness differential between directional microphone assembly 253 and directional microphone assembly 101 may be seen by comparison of FIGS. 22 and 23 to FIGS. 2 and 8, for example.

Figure 24:
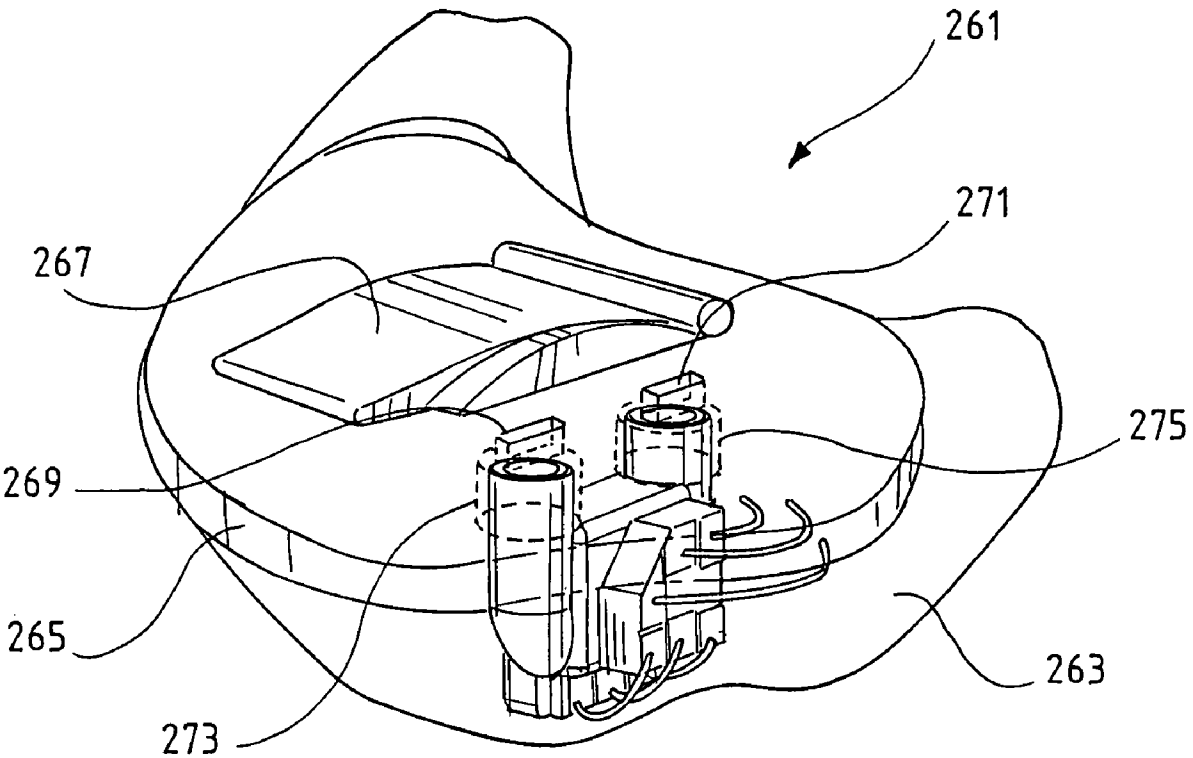
FIG. 24 illustrates an in-the-ear hearing aid having a directional microphone assembly mounted therein.

FIG. 24 illustrates an in-the-ear hearing aid having a directional microphone assembly mounted therein. The directional microphone assembly may, for example, be that shown in FIG. 17. Hearing aid 261 comprises a shell 263 and a faceplate 265 mounted to the shell 263. Faceplate 265 includes a battery door 267 as well as acoustic openings 269 and 271. Acoustic openings 269 and 271, which are shown as rectangular, may also be oval, circular, or any other shape. Acoustic openings, 269 and 271 acoustically couple sound from the sound field through the faceplate 265 to respective sound ducts of the directional microphone assembly.

Faceplate 265 also includes on its inner surface a pair of locating wells 273 and 275 for receiving respective sound ducts of the directional microphone assembly. Upon assembly of the hearing aid, the sound ducts of the directional microphone assembly are respectively inserted into the locating wells 273 and 275. The sound ducts may be press-fit into the wells, for example. Epoxy or other adhesive material may also be used to secure the directional microphone assembly to the faceplate. Once the directional microphone assembly is secured and electrically connected to hearing aid circuitry (not shown), the faceplate 265 is then mounted to the shell 263 to form the complete hearing aid 261.

Figure 25:
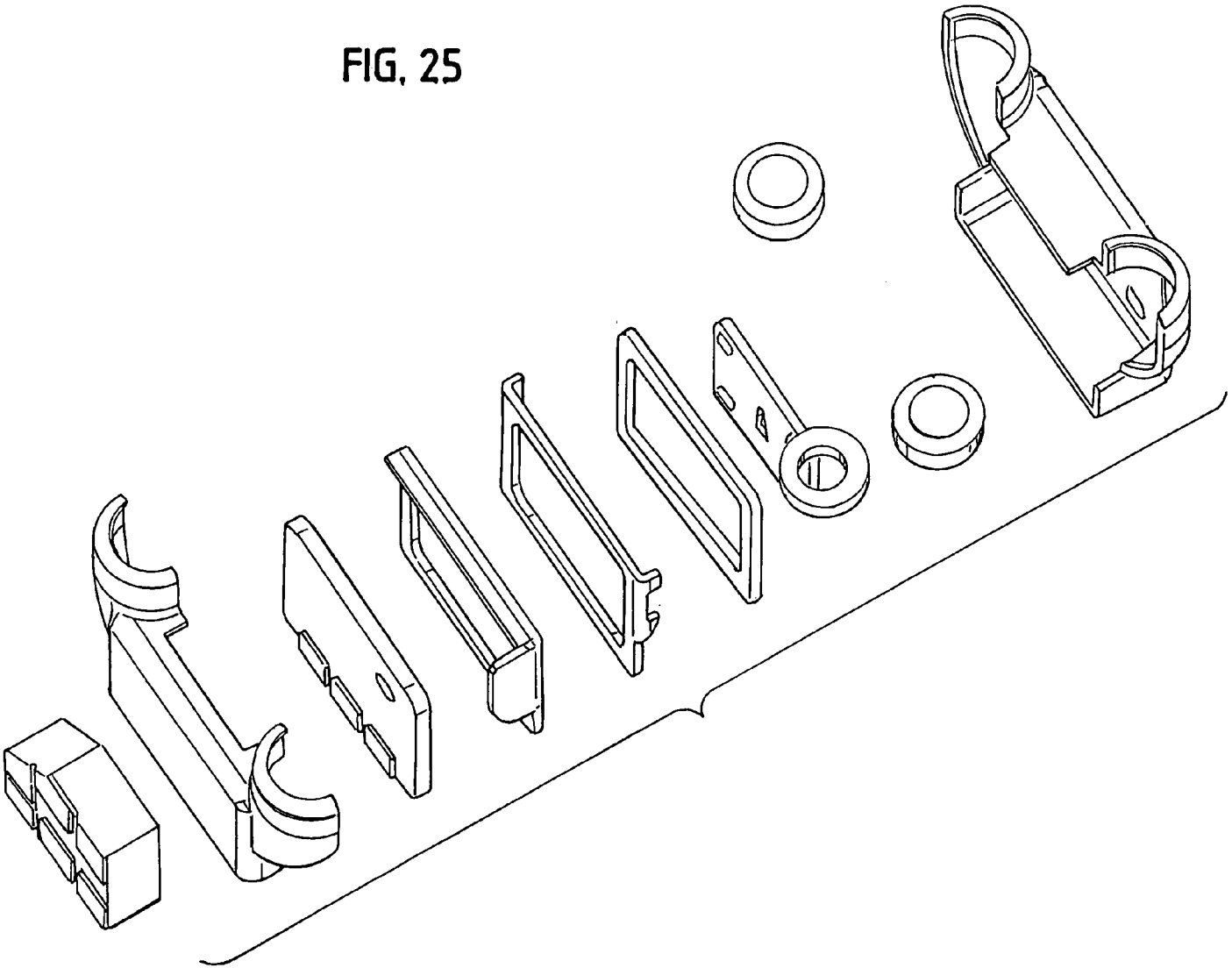
FIG. 25 is an exploded view of the directional microphone assembly of FIGS. 11-14, illustrating the internal components as well as the cartridge portions.
Figure 26A:
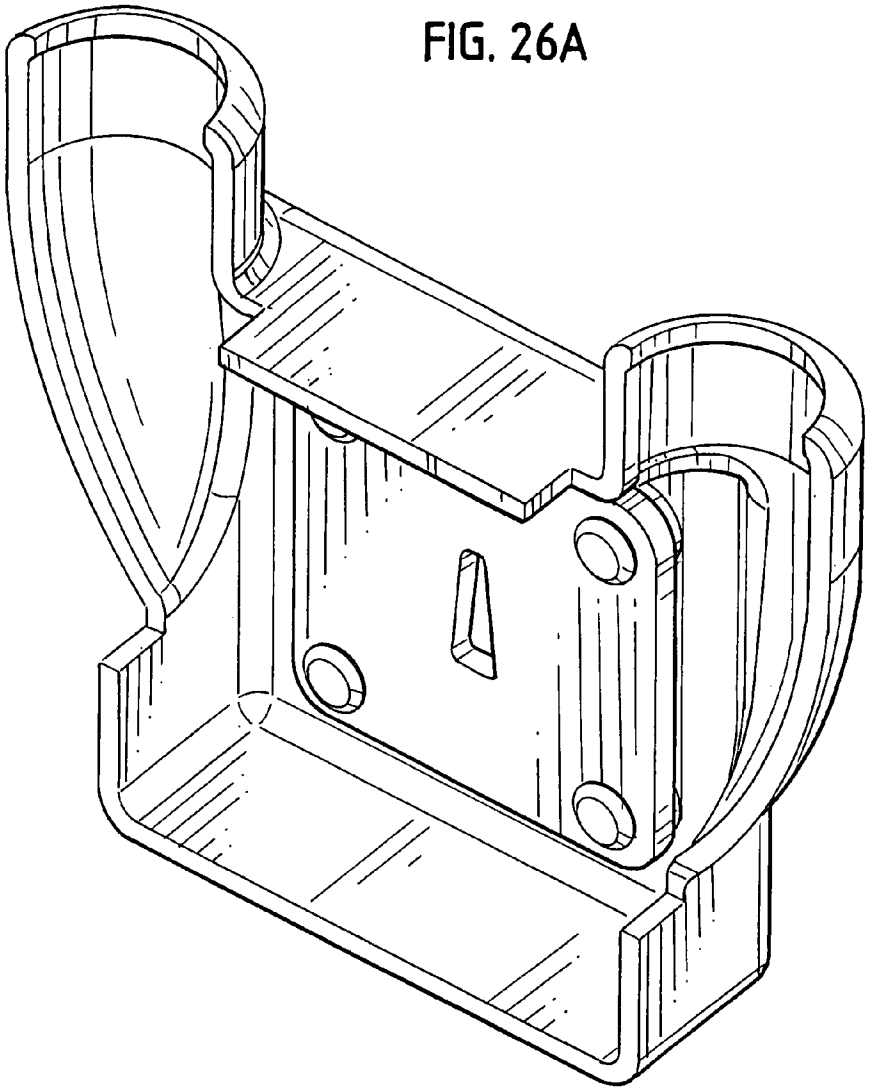
FIGS. 26A-G collectively illustrate a component by component assembly technique for the directional microphone assembly of FIGS. 11-14, using the components set forth in FIG. 25.
Figure 26B:
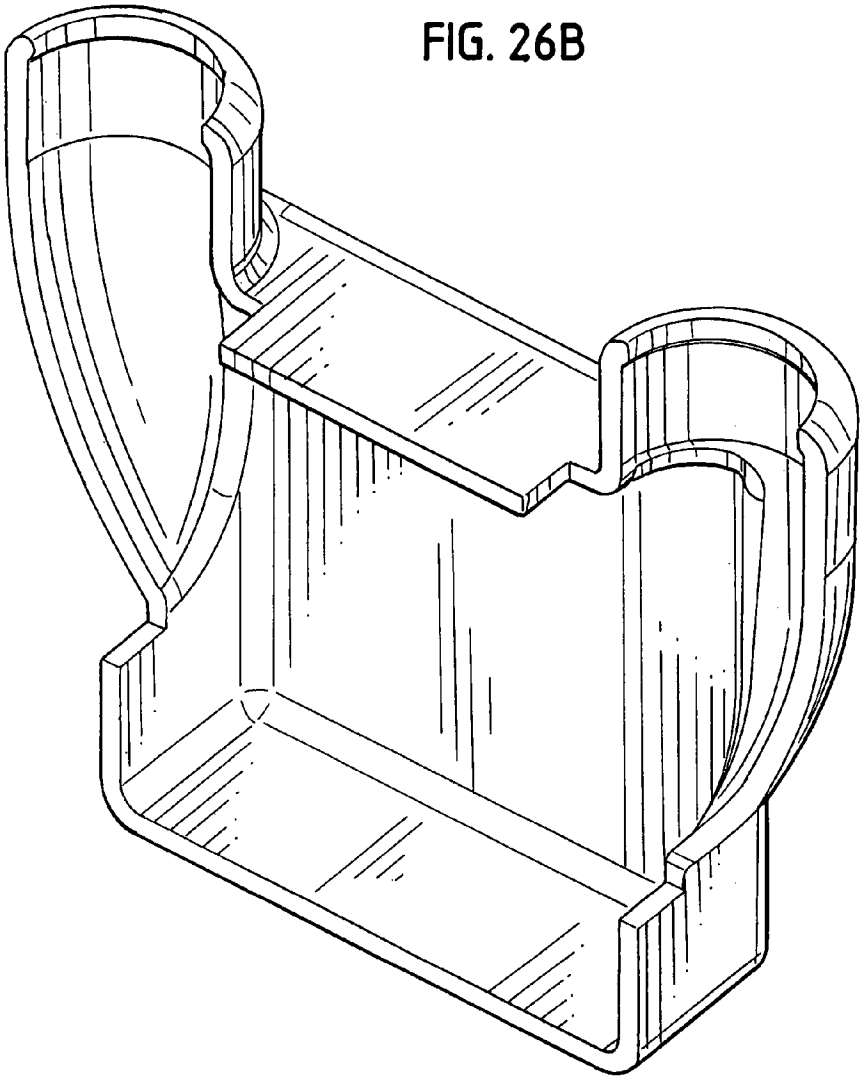
Figure 26C:
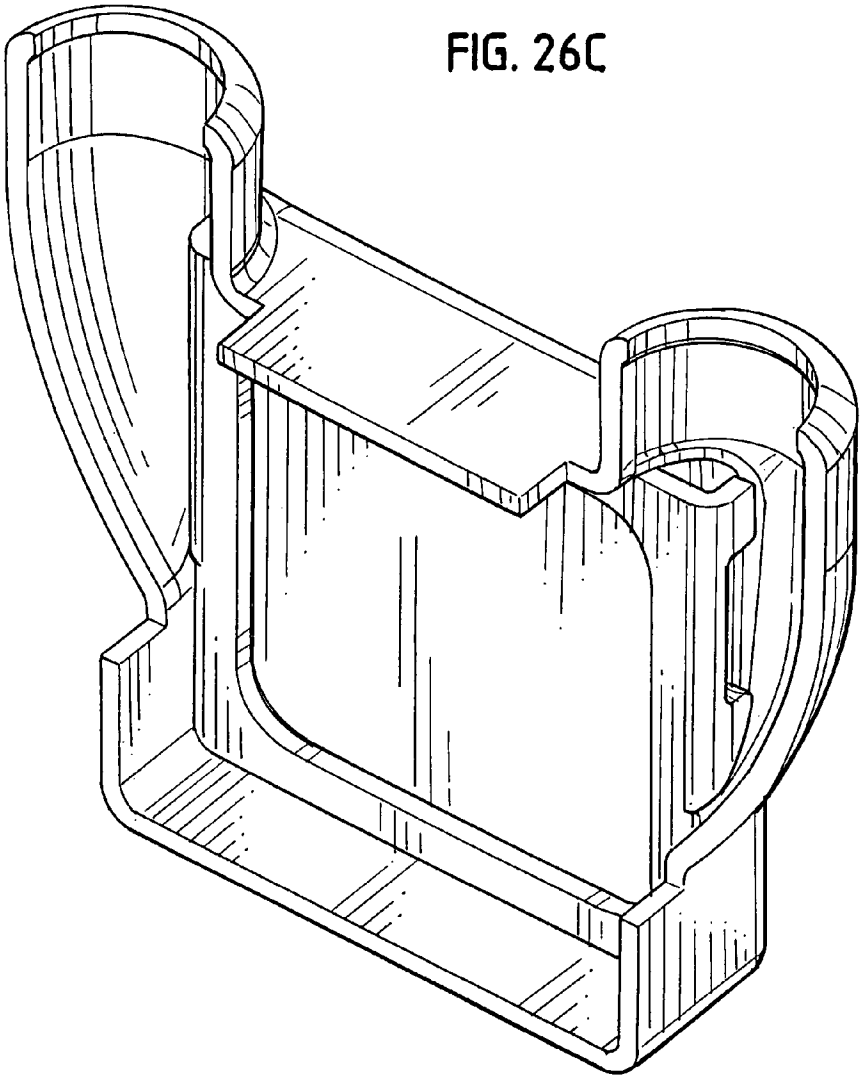
Figure 26D:
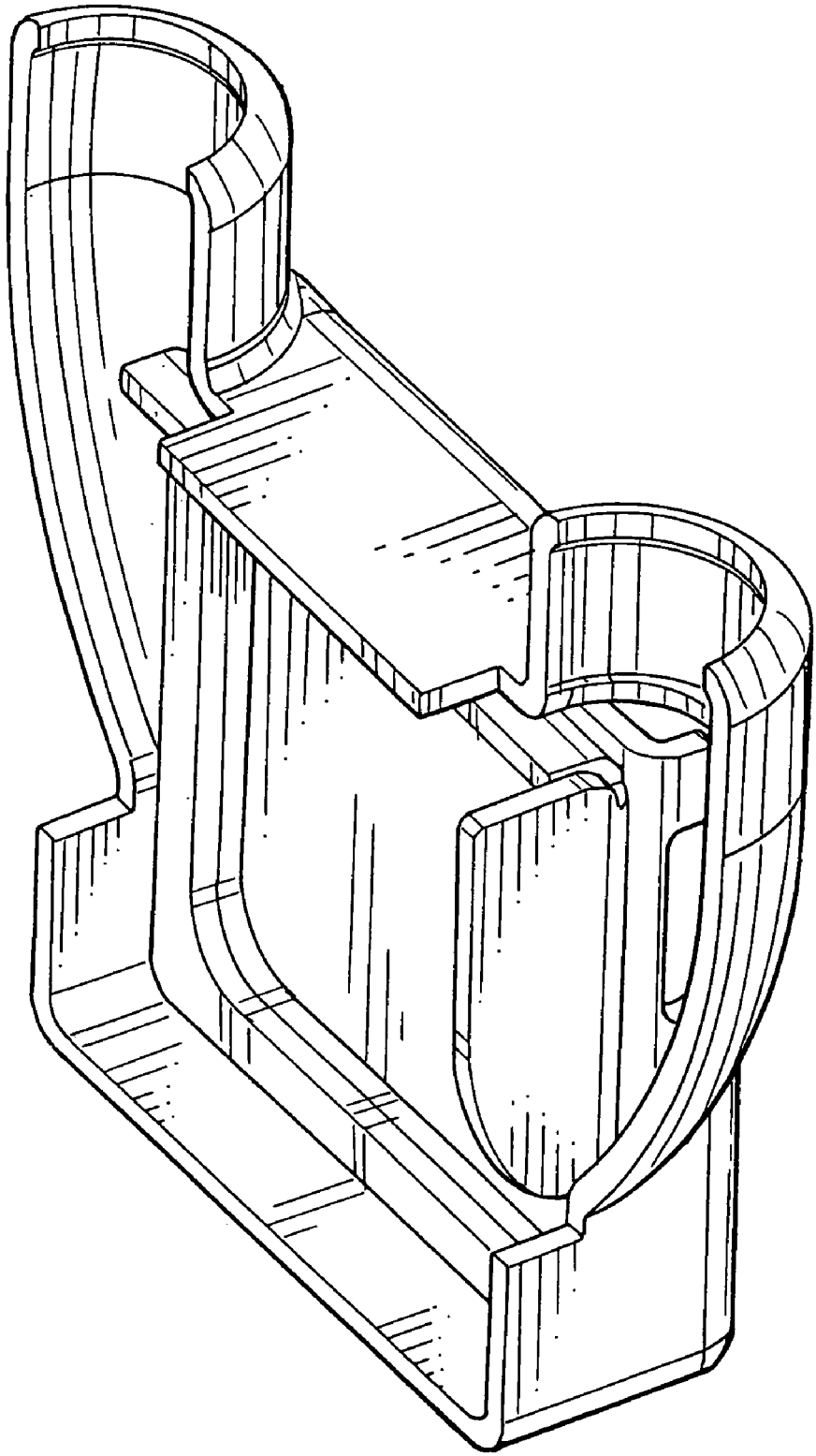
Figure 26E:
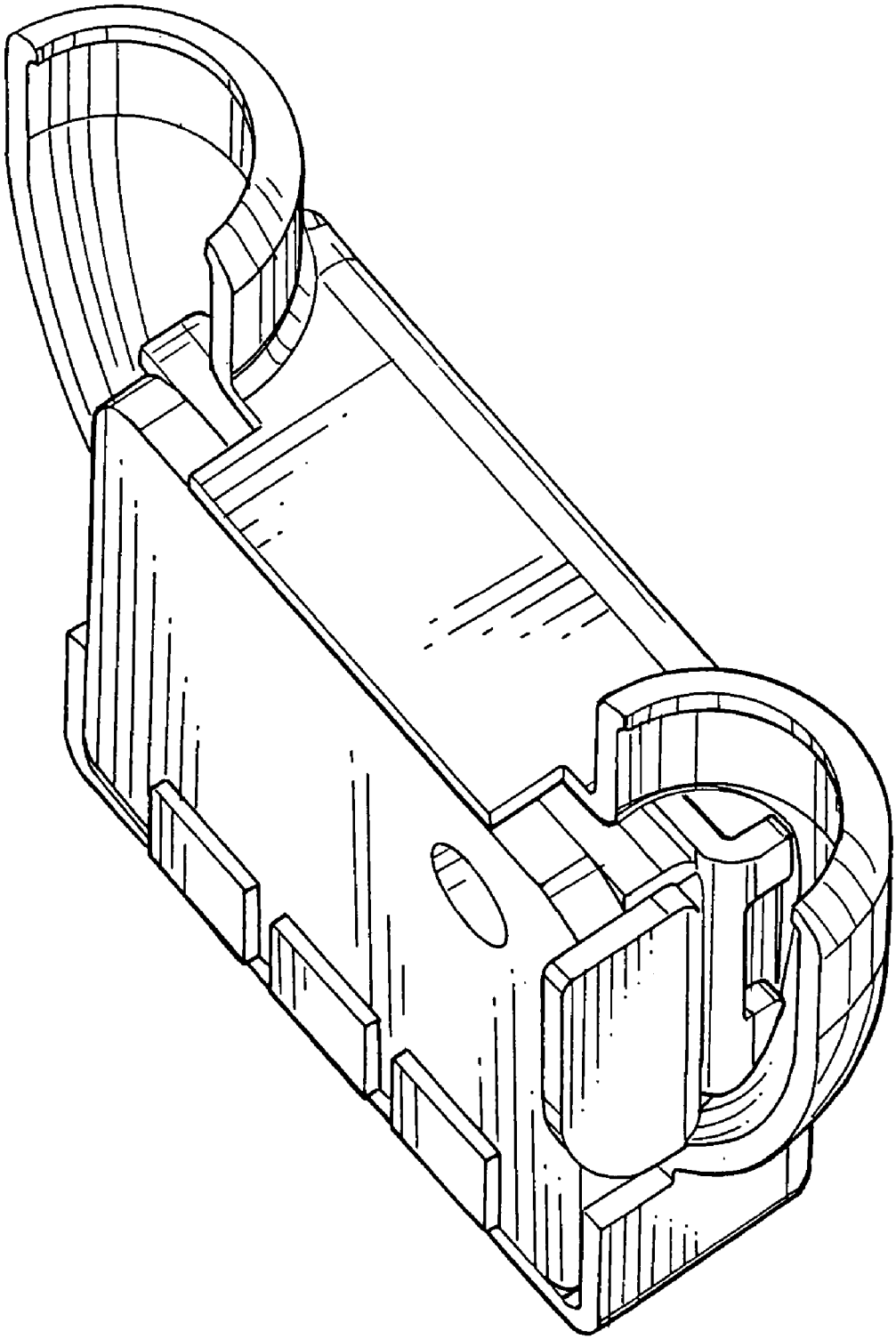
Figure 26F:
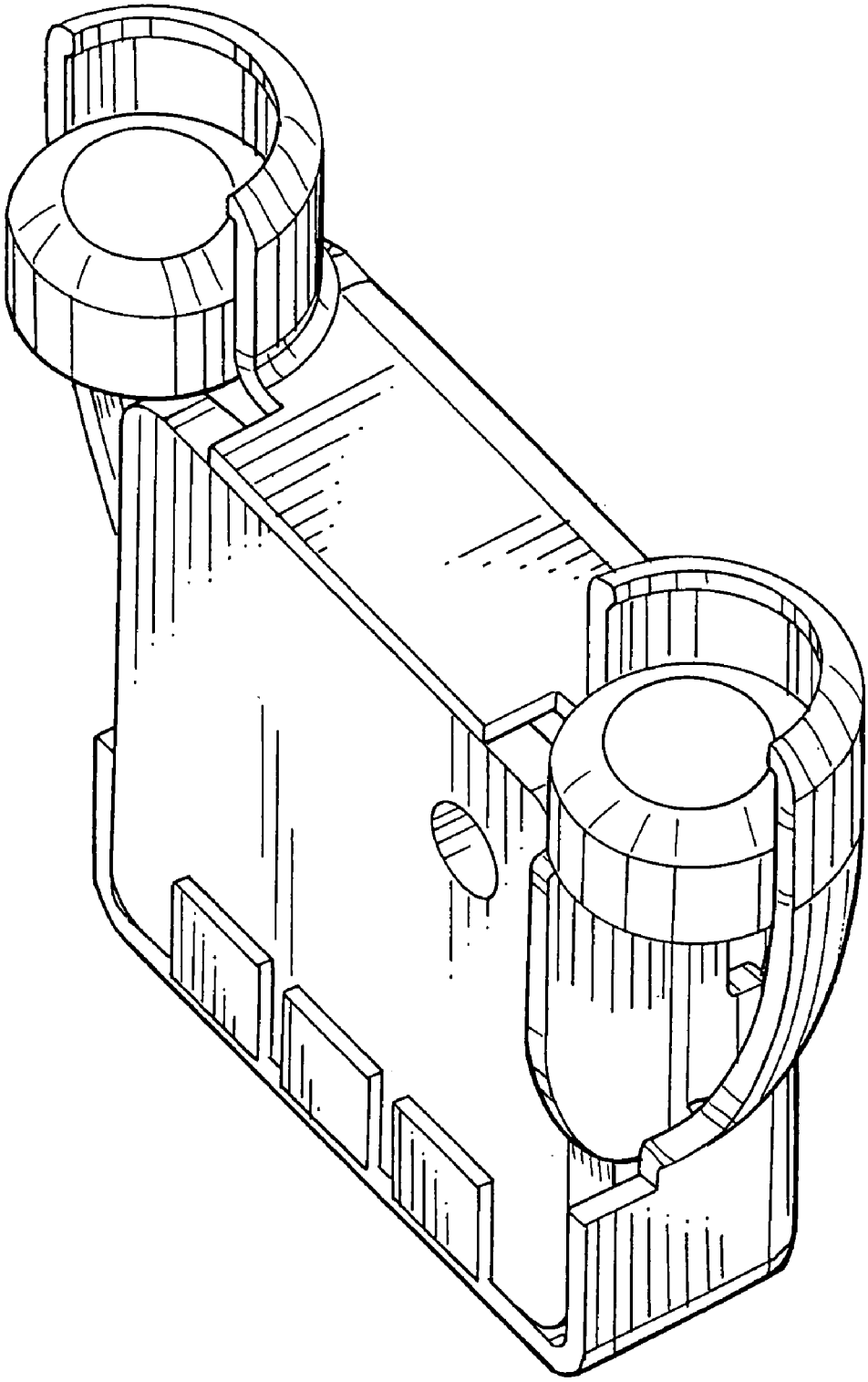
Figure 26G:
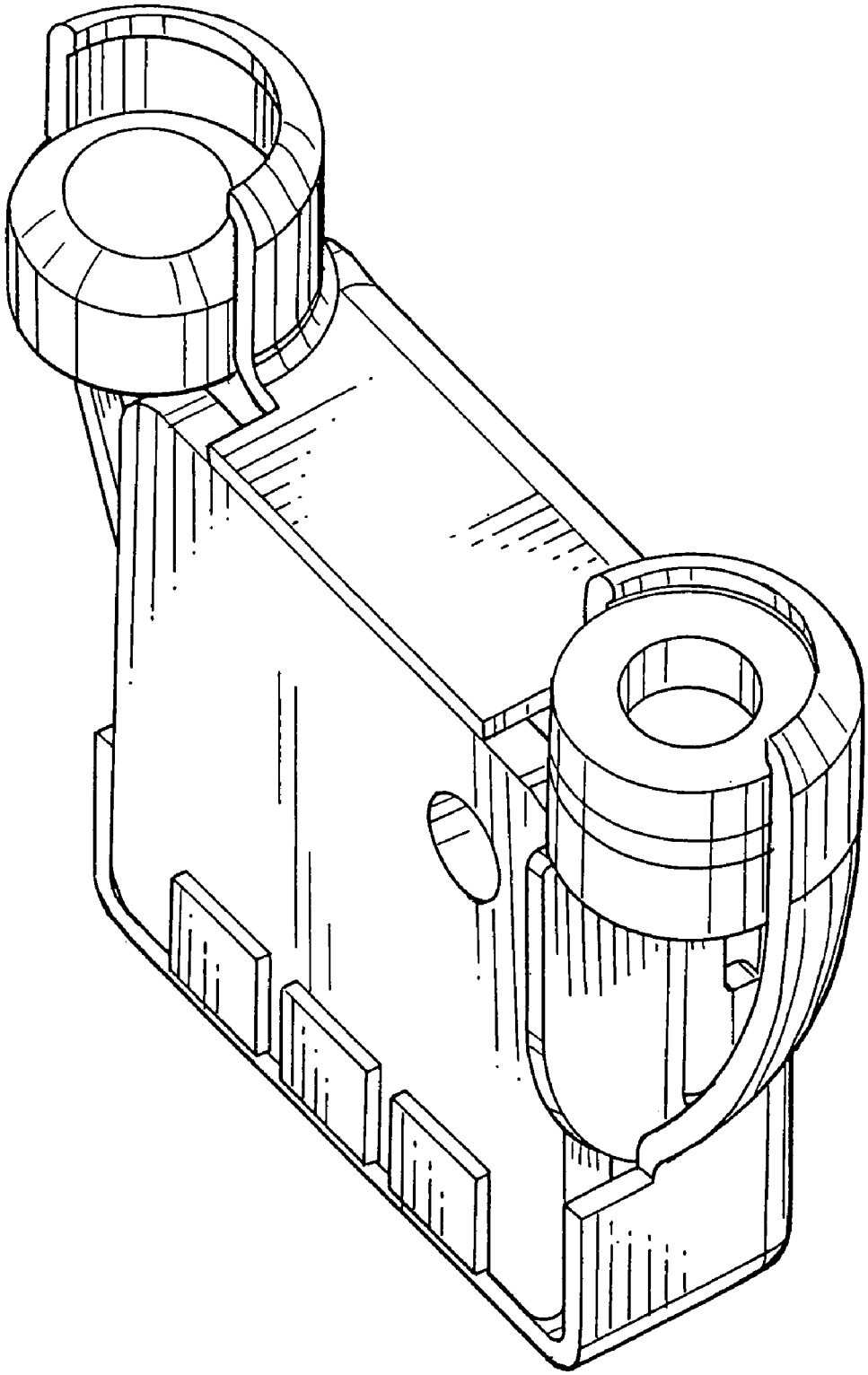
Figure 27A:
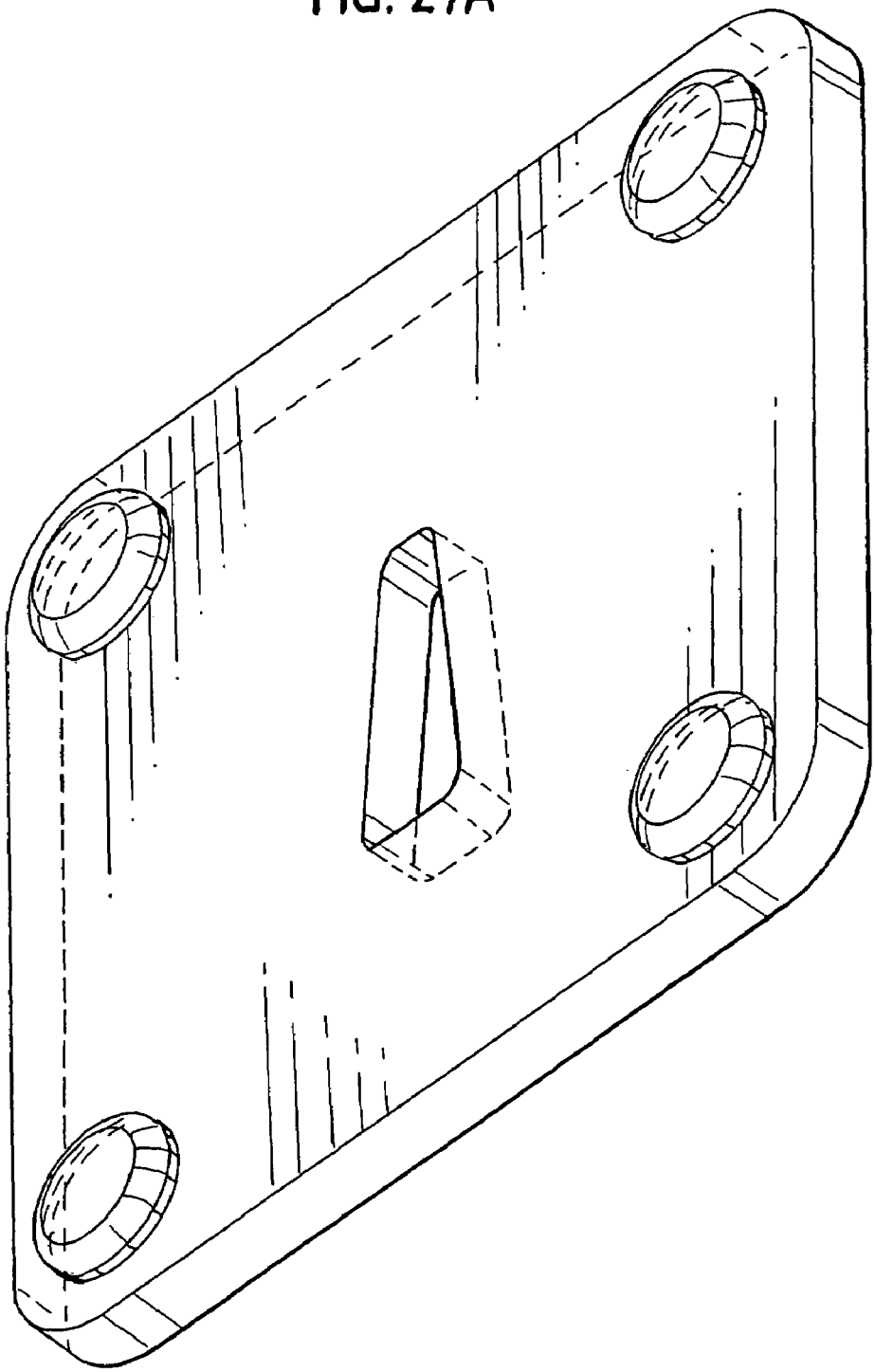
FIGS. 27A-G respectively illustrate the individual components set forth in FIG. 25.
Figure 27B:
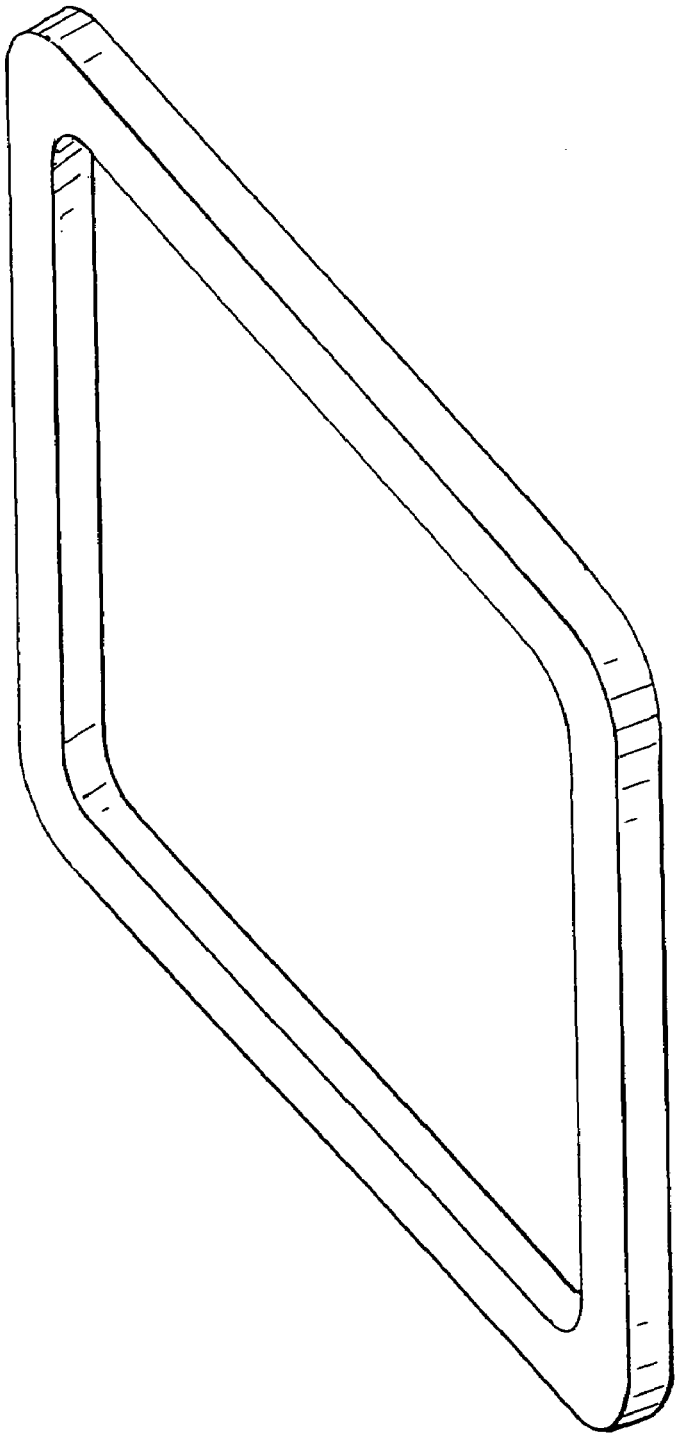
Figure 27C:
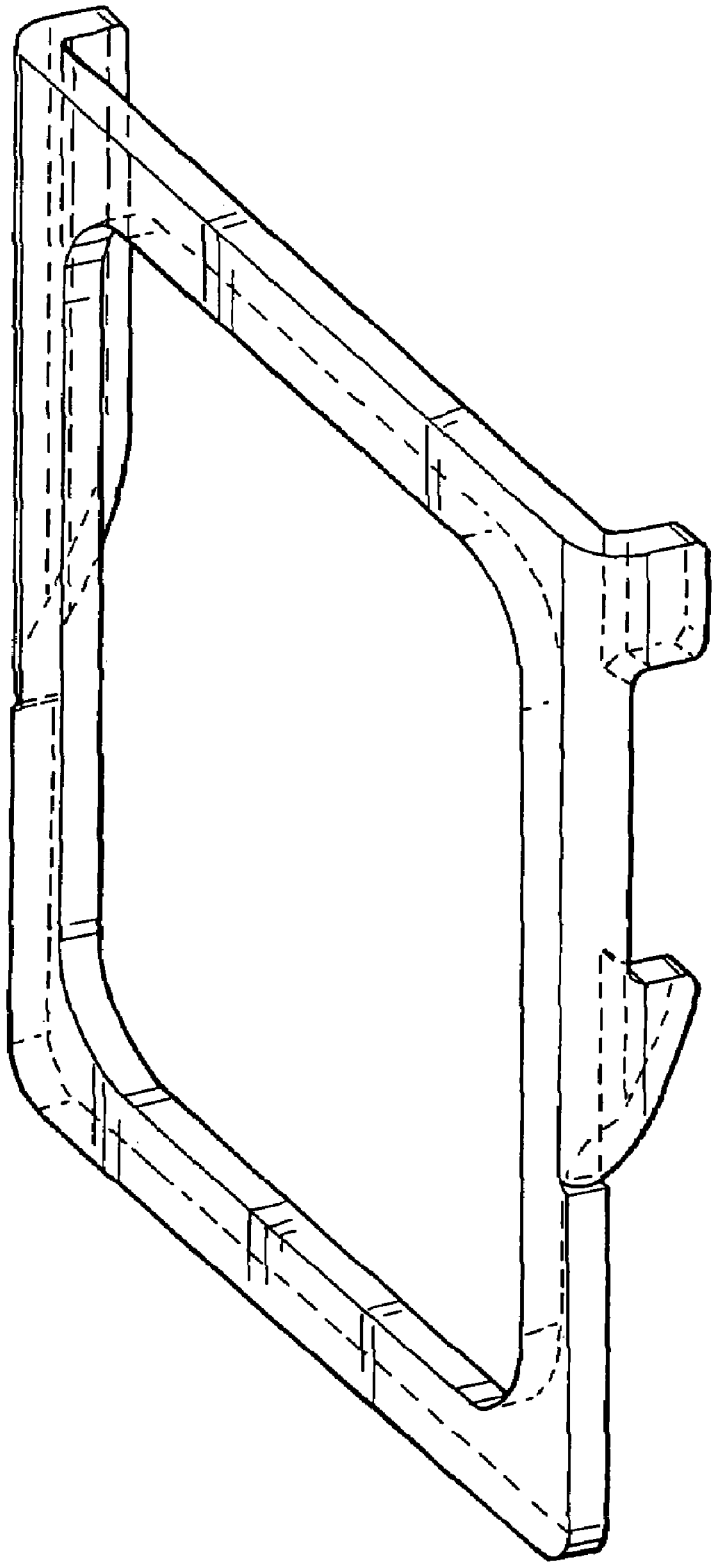
Figure 27D:
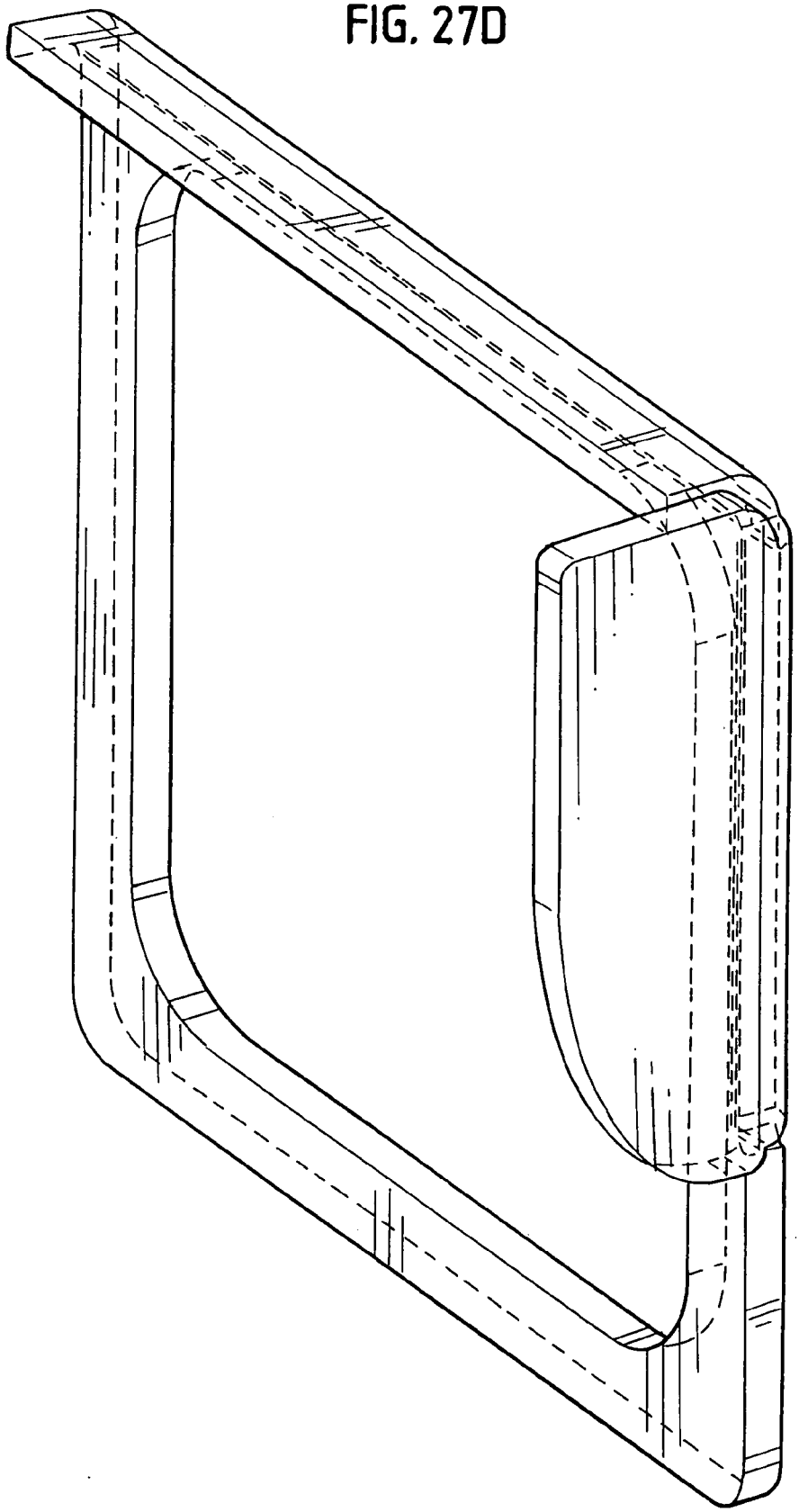
Figure 27E:
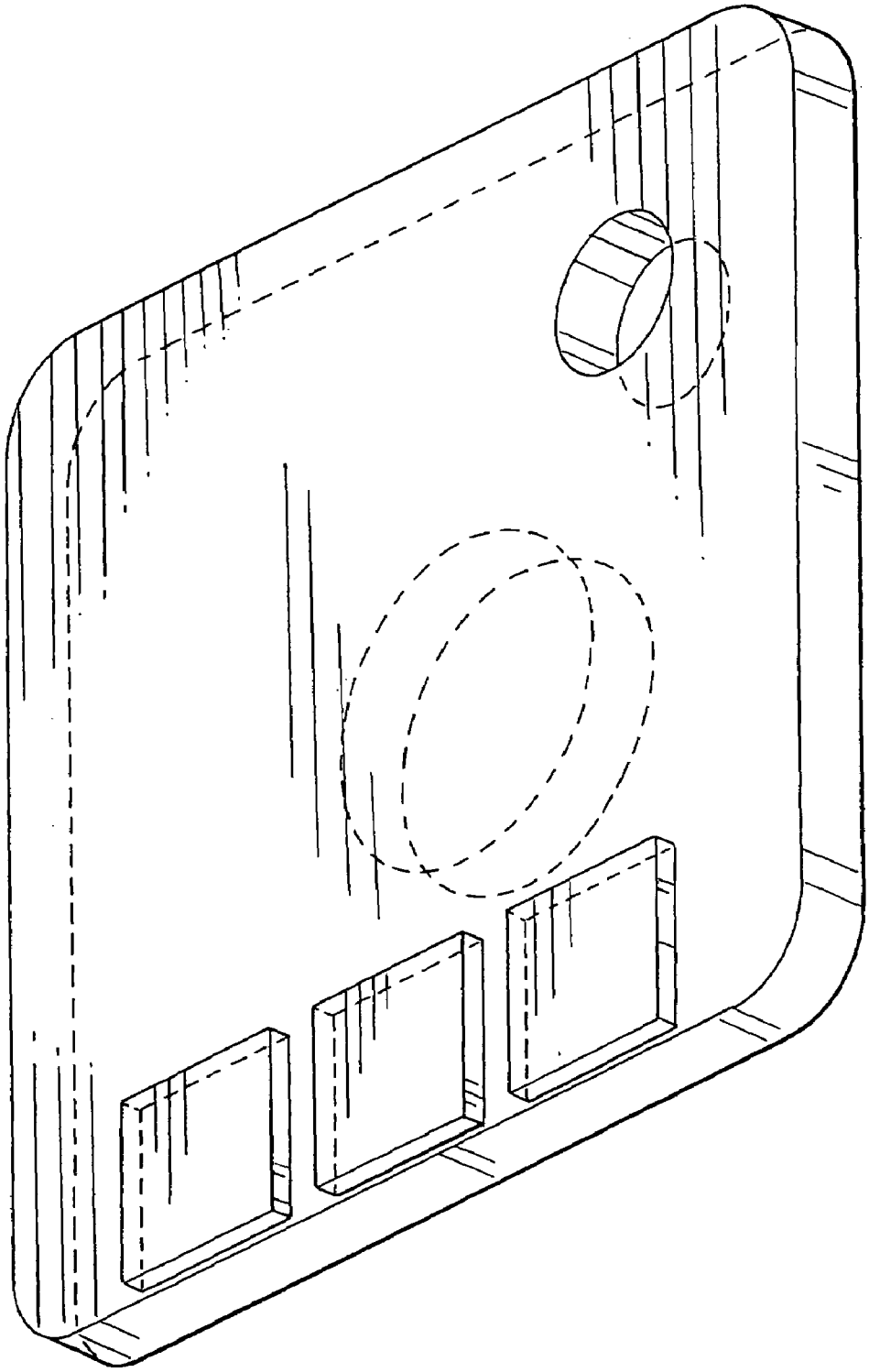
Figure 27F:
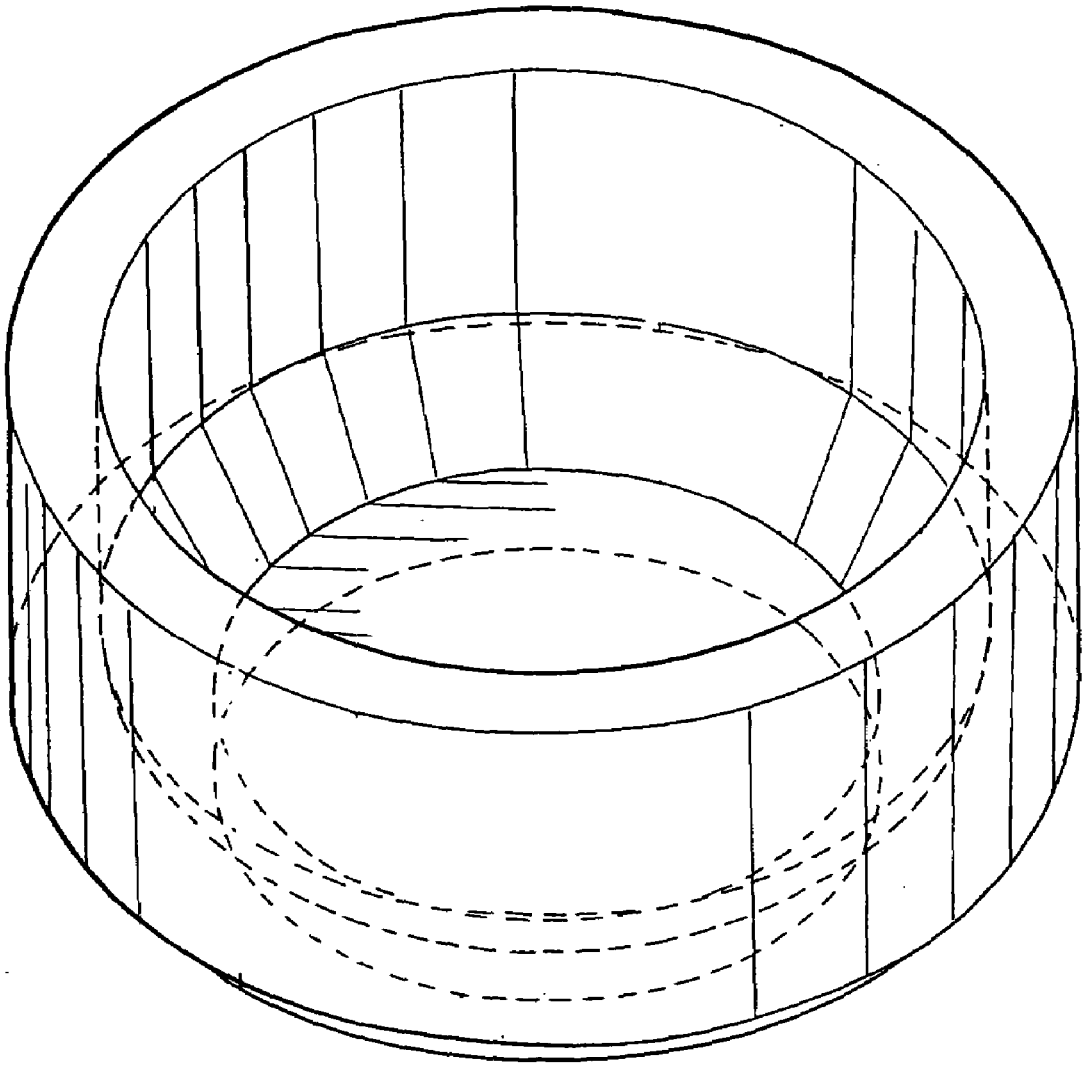
Figure 27G:
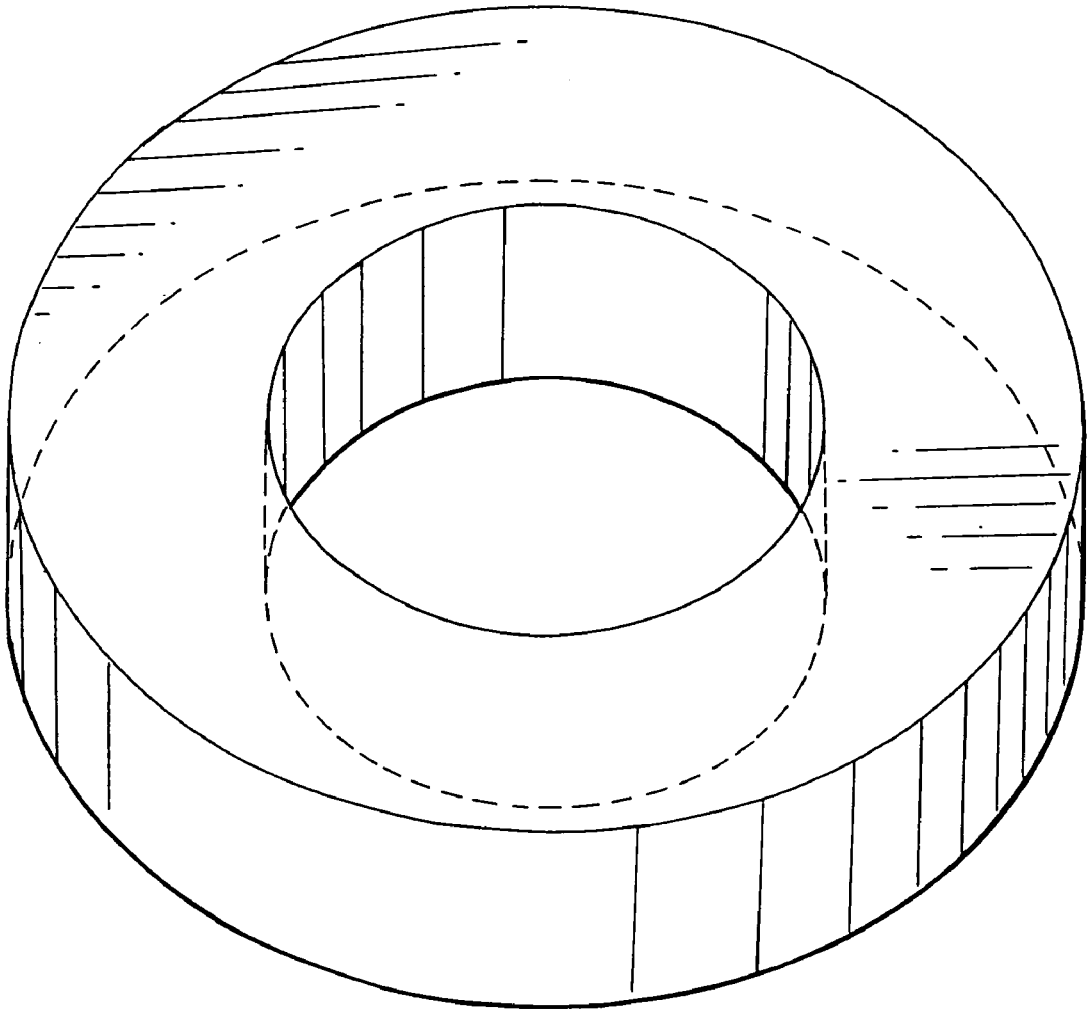

FIG. 25 is an exploded view of the directional microphone assembly of FIGS. 11-14, illustrating the internal components as well as the cartridge portions.

FIGS. 26A-G collectively illustrate a component by component assembly technique for the directional microphone assembly of FIGS. 11-14, using the components set forth in FIG. 25.

FIGS. 27A-G respectively illustrate the individual components set forth in FIG. 25.

Figure 28:
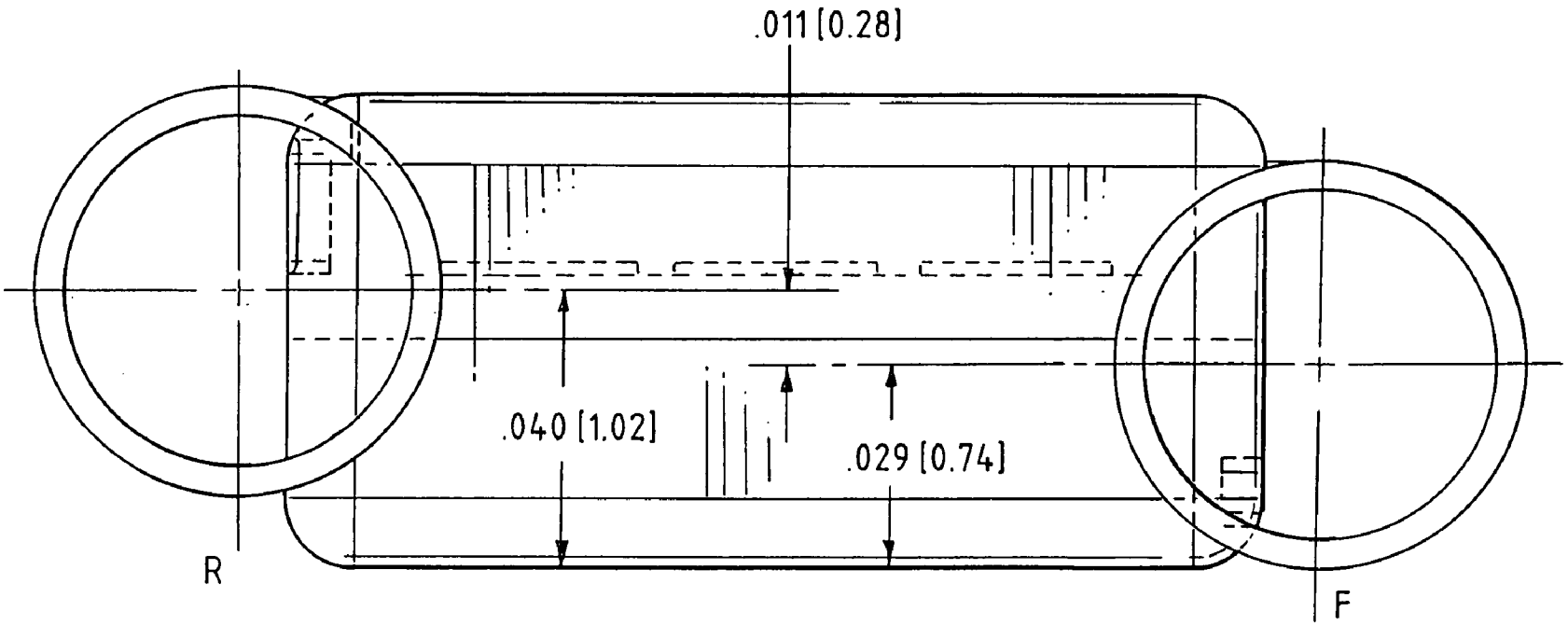
FIG. 28 is a top view of an alternate embodiment of the directional microphone assembly of the present invention, in which the sound ducts are offset from each other and relative to the center of the case housing.

FIG. 28 is a top view of an alternate embodiment of the directional microphone assembly of the present invention, in which the sound ducts are offset from each other and relative to the center of the case housing.

Many modifications and variations of the present invention are possible in light of the above teachings. Thus, it is to be understood that, within the scope of the appended claims, the invention may be practiced otherwise than as described hereinabove.

What is claimed is:

1. A hearing aid comprising:

a directional microphone assembly comprising a housing having opposing side walls, the opposing sides walls having opposing sound ducts formed thereon; and a directional microphone cartridge comprising opposing side portions, wherein the opposing side portions of the directional microphone cartridge extend at least partially into the opposing sound ducts of the opposing side walls of the directional microphone assembly thereby reducing an overall dimension of the directional microphone assembly.

2. The hearing aid according to claim 1, wherein the opposing side portions of the directional microphone cartridge have a first length therebetween, and the opposing side walls of the directional microphone assembly have a second length therebetween, and wherein the first length is longer than the second length.

3. The hearing aid according to claim 1, wherein each of the opposing sound ducts has an inside volume, and wherein at least a portion of at least one inside volume is formed by a surface of the directional microphone cartridge extending at least partially into an interior of the opposing sound ducts.

4. The hearing aid according to claim 1, wherein each of the opposing sound ducts forms a sound passage having an inside volume formed at least in part by a portion of a top surface and a portion of a side surface of the directional microphone cartridge extending into an interior of the opposing sound ducts.

5. The hearing aid according to claim 1, wherein at least one of the opposing sound ducts of the directional microphone assembly is adapted to receive a restrictor inserted therein, the restrictor and an interior of the at least one of the opposing sound ducts having a frictional fitting relationship, the restrictor being positioned flush with a top surface of the directional microphone cartridge within the at least one of the opposing sounds ducts, wherein the restrictor increases an acoustical inertance of a sound passage formed by the interior of the at least one of the opposing sound ducts.

6. The hearing aid according to claim 1, wherein the directional microphone assembly further comprises acoustic dampers disposed in top portions of the opposing sound ducts, wherein the acoustic dampers are inserted into inlets of the opposing sound ducts in a frictional fit manner.

7. The hearing aid according to claim 1, wherein the directional microphone cartridge comprises an equalization circuit, the equalization circuit comprising a plurality of electrical contacts for operatively connecting the equalization circuit to additional hearing aid circuitry comprising a hearing aid amplifier.

* * * * *